US008496427B2

(12) United States Patent
Curotto et al.

(10) Patent No.: US 8,496,427 B2
(45) Date of Patent: Jul. 30, 2013

(54) FRONT-LOADABLE REFUSE CONTAINER HAVING SIDE-LOADING ROBOTIC ARM WITH MOTORS AND OTHER MASS MOUNTED AT REAR OF CONTAINER AND USE OF SAME WITH FRONT-LOADING WASTE-HAULING VEHICLE HAVING HYDRAULIC FRONT FORKS OR OTHER RETRACTABLY ENGAGEABLE LIFT MEANS

(75) Inventors: John M. Curotto, Sonoma, CA (US); Edward M. Suden, Napa, CA (US); Gideon Gimlan, Los Gatos, CA (US)

(73) Assignee: The Curotto-Can, LLC, Chattanooga, TN (US)

( * ) Notice: Subject to any disclaimer, the term of this patent is extended or adjusted under 35 U.S.C. 154(b) by 0 days.

(21) Appl. No.: 13/294,387

(22) Filed: Nov. 11, 2011

(65) Prior Publication Data

US 2012/0087773 A1 Apr. 12, 2012

Related U.S. Application Data

(62) Division of application No. 12/492,639, filed on Jun. 26, 2009, now Pat. No. 8,092,141, which is a division of application No. 11/731,092, filed on Mar. 29, 2007, now Pat. No. 7,553,121, which is a division of application No. 10/688,474, filed on Oct. 16, 2003, now Pat. No. 7,210,890.

(51) Int. Cl.
*B65F 3/04* (2006.01)

(52) U.S. Cl.
USPC ..... 414/810; 414/812

(58) Field of Classification Search
USPC ..... 414/406, 408, 421, 501, 549, 551, 414/555, 810, 812
See application file for complete search history.

(56) References Cited

U.S. PATENT DOCUMENTS 2,058,682 A * 10/1936 Green ..... 414/537
2,702,142 A * 2/1955 Jones ..... 220/324
3,762,586 A 10/1973 Updike, Jr.
3,822,802 A 7/1974 Evans, Jr.
3,841,508 A 10/1974 Ebeling et al.

(Continued)

FOREIGN PATENT DOCUMENTS

WO 91/00231 A1 1/1991

OTHER PUBLICATIONS

Supplementary European Search Report mailed Feb. 22, 2013, in related European Application No. 04795246.0.

*Primary Examiner* — James Keenan
(74) *Attorney, Agent, or Firm* — Haynes and Boone, LLP

(57) ABSTRACT

A modular front-loading, refuse collecting vehicle has a low-profile, front-loadable waste bin (intermediate container) and a side-loading robotic arm. To reduce mechanical stresses, a major portion of the mass of the robotic arm mechanism is situated to the rear of the intermediate container so that a mass and beam combination is defined where the mass-supporting beam has reduced length. More specifically, hydraulic and/or other relatively massive motor devices of the robotic arm mechanism are mounted to the rear of a refuse-containing wall of the intermediate container. Elastomeric and/or other dampening devices may be interposed between the vehicle and the bulk mass of the combination of the intermediate container and robotic arm mechanism for converting into heat some vibrational energy. A modular sled system may be provided for supporting different robotic arms in combination with refuse containers made of different materials.

20 Claims, 13 Drawing Sheets

U.S. PATENT DOCUMENTS 4,543,028 A 9/1985 Bell et al.
5,361,978 A * 11/1994 Monroe ..... 232/43.1
5,607,277 A 3/1997 Zopf
5,639,201 A 6/1997 Curotto
5,833,428 A 11/1998 Szinte
5,938,394 A 8/1999 Christenson
6,123,497 A 9/2000 Duell et al.
6,139,244 A 10/2000 VanRaden
6,167,795 B1 1/2001 Bayne et al.
6,202,922 B1 * 3/2001 Phillips et al. ..... 232/43.1
6,296,132 B1 * 10/2001 Pickler ..... 220/1.5
6,325,587 B1 12/2001 Wysocki et al.
6,357,988 B1 3/2002 Bayne
6,632,064 B1 10/2003 Walker et al.
7,210,890 B2 5/2007 Curotto et al.
7,213,860 B2 * 5/2007 Brenneman et al. ..... 296/61
7,559,734 B2 * 7/2009 Khan et al. ..... 414/408
2005/0111942 A1 5/2005 Rimsa et al.

* cited by examiner

100

Z
+X
Y
402"
402f"
402c"
450c"

400"
Elastomeric Pads
402d"
450"
450b"
402b"
402g"
403
407
405a
402e"
432"
402a"
404
405
460b"
432a"

700

FRONT-LOADABLE REFUSE CONTAINER HAVING SIDE-LOADING ROBOTIC ARM WITH MOTORS AND OTHER MASS MOUNTED AT REAR OF CONTAINER AND USE OF SAME WITH FRONT-LOADING WASTE-HAULING VEHICLE HAVING HYDRAULIC FRONT FORKS OR OTHER RETRACTABLY ENGAGEABLE LIFT MEANS

CROSS-REFERENCE TO RELATED APPLICATIONS

The present application is a division of U.S. patent application Ser. No. 12/492,639 filed on Jun. 26, 2009, incorporated herein by reference, (now U.S. Pat. No. 8,092,141 issued Jan. 10, 2012), which claims priority of Taiwan R.O.C. patent application No. 097124867 filed Jul. 2, 2008, and which U.S. patent application Ser. No. 12/492,639 is a division of U.S. patent application Ser. No. 11/731,092 filed on Mar. 29, 2007, incorporated herein by reference, now U.S. Pat. No. 7,553,121, which is a division of U.S. patent application Ser. No. 10/688,474 filed on Oct. 16, 2003, incorporated herein by reference, now U.S. Pat. No. 7,210,890.

FIELD OF DISCLOSURE

The present disclosure of invention relates generally to commercial-scale collection and hauling of refuse in residential and industrial settings.

The disclosure relates more specifically to so-called intermediate containers which can be transported by a vehicle and can receive collected refuse intermediate to the refuse being dumped into a larger refuse-containing hopper of the transport vehicle.

The disclosure relates yet more specifically to the positioning of, and/or mounting of, motor-driven (e.g., hydraulically-actuated) collection-assisting devices such as robotic arms, relative to the positioning of a refuse container (e.g., an intermediate container) which can be engaged and lifted by a retractably engageable lift means such as a fork-lift, particularly when the combination of container and motor-driven collection-assisting device(s) is lifted by forks or other retractably engageable lift means provided on a steered transportation vehicle (e.g., a waste collection truck with front forks) and when the collection-assisting device(s) receive power and/or command from the vicinity of the transportation vehicle.

CROSS-REFERENCE TO PATENTS

The disclosures of the following U.S. patents are incorporated herein by reference:

(A) U.S. Pat. No. 5,639,201 issued Jun. 17, 1997 to John D. Curotto and entitled "Materials Collecting Apparatus";

In order to avoid front end clutter, this cross referencing section (3) continues as (3a) at the end of the disclosure, slightly prior to recitation of the patent claims. The mere citation of recent patents or applications herein does not constitute admission of prior art status.

DESCRIPTION OF RELATED ART

Front-loading waste-collecting and hauling vehicles are ubiquitous in the commercial refuse collection industry. Typically, when front-loading is employed, a heavy-duty truck or a like, steerable vehicle is provided with a pair of hydraulically-actuated front forks situated to extend in front of the vehicle. The forks can be raised, lowered and tilted in front of the driver's cab so that an operator can see the forks, guide the forks into lifting engagement with a front-loadable refuse container and lift the container with the forks.

Conventionally, fork-accepting pockets are provided at the sides of fork-liftable refuse containers. The pockets may be made entirely of metal and may be welded to the metallic sidewalls of a standard-width refuse collecting bin or they may be formed as integral extensions of the metallic bottom floor of the collecting bin. A standard-width refuse collecting bin may be one having a width of approximately 81 inches if it is a so-called, 2 yard to 6 yard refuse bin as used in the USA. Bin widths and/or fork spacing distances may vary somewhat in different locations.

Alternatives to fork-based lifting are available. One such alternative may be referred to as the A-frame approach. A triangularly shaped indent is provided on the back wall of the refuse container with protrusion receiving slots formed on the inner surfaces of the triangularly shaped indent. Mating and machine-driven, retractable protrusions may be provided on a matching, triangularly shaped, engagement head which rides on the front of the refuse truck, between hydraulically lifted arms of the truck. After the head engages into the indent, the protrusions may be driven and/or inserted into their respective slots so as to grab hold of the back wall of the refuse container. The hydraulic lift arms then lift the container for movement. Release of the container includes retraction and/or de-insertion of the protrusions from their respective, in-A-frame slots. The A-frame approach is not as common as the fork lift approach. Accordingly, much of this disclosure will focus on the fork lift approach. However, in doing so, this disclosure nonetheless contemplates the A-frame approach and other forkfree alternative ways of mechanically engaging and lifting large refuse containers.

During a waste collection operation which takes place under the fork lift approach, the fork-liftable bin is often placed and oriented so that a collections vehicle can easily drive forward towards a back wall of the bin and insert its forks into fork-receiving pockets of the bin, under driver supervision. The fork insertion operation may include the step of pre-aligning the forks so they can extend forward clear of the back wall and the step of tilting the forks so that they will enter fork-receiving openings of the pockets as the vehicle drives forward. The vehicle driver and/or an additional fork operator is/are responsible for angling, altering the height of, or otherwise aligning the forks with the pocket openings as the collections vehicle drives forward so that the forks will properly engage with the pockets. After the forks are fully inserted into the pockets, the cab driver and/or the assisting operator can initiate a motorized (e.g., hydraulic) operation which will untilt and/or lift the inserted forks and thereby raise the refuse bin off the ground for transporting it or emptying its contents. Often the contents of the fork-lifted bin are emptied into a rear-mounted hopper that sits behind the driver's cab. An over-the-top translating action is often used to position the lifted bin over the truck's back hopper and to dump the container's refuse into the back hopper.

The front-loading lift and/or dump-over-the-top operation is typically performed under manual-control. Controllers such as air-powered hydraulic actuators or other such motor controls are typically provided inside the drivers cab so that an in-cab operator (the driver or another person) can manipulate them in order to activate hydraulic pistons or other motor means in a desired sequence so as to move the forks and the fork-supported refuse bin and so as to bring the bin and forks into manually-determined positions. It is not uncommon in the haste of trying to do the job quickly, for an operator to misjudge the position of an upwardly-rising bin and to prematurely initiate a fork titling motion during the execution of an over-the-top dumping operation. Such a premature tilt may cause the refuse bin to miss its intended target, namely, an opening at the top of the rear-mounted hopper (a hopper that rides behind the operator's cab) and instead to tilt and crash into an upper front portion of the truck (e.g., the cab roof). This premature tilt is sometimes referred to as a "short dump". Appropriate, all-metal reinforcements are typically built into the truck, the back hopper, and the fork-liftable refuse bin to absorb the shock of such accidental, "short dump" collisions.

Because the front-loading style of waste-collecting vehicles is so ubiquitous in the industry, it has become highly desirable to be able to modularly switch the mode of operation of such vehicles between the more traditional, and commercially-oriented, front-loading duty for which they were initially designed, and a side-loading type of refuse collecting operation which is more appropriate for residential-style collections.

When side-loading is used, the collection truck drives roughly parallel to the curb of a residential street. Residential-sized waste baskets, cans or other holders of loose refuse material and/or non-contained refuse items are placed near or along the curb for pick up. In one version of side loading, a low-profile refuse bin (e.g., a 4-yard bin) rides on the front forks of the truck, slightly lifted and leveled above the roadway. The driver and/or other human assistants run out to the curb, manually fetch and haul the curbside waste to the front-riding, low-height bin (e.g., a so-called intermediate container). Then they manually empty the baskets and/or toss the refuse items into the bin. Empty baskets are usually manually returned to positions near their point of origin so that residential owners can determine which empty waste can(s) are theirs.

Such manual fetching, hauling, lifting and/or return of waste cans tends to be exhausting and time consuming. Attempts have been made to automate the process. For example, U.S. Pat. No. 6,123,497 (Duell, et al.) teaches a fork-liftable intermediate container that has a curb-side cart dumper integrated into its curb-side side wall. The curb-side cart dumper is hydraulically powered to facilitate the lifting of the waste baskets (or, curb-side carts, as they may be called) over the low profile height of the intermediate container and into the interior space of the intermediate container. One drawback of this type of curb-side cart dumper is that the vehicle driver still has to step out from the driver's cab, fetch the waste can, and manually attach the cann (or curb-side waste-cart as it may be called) to the integrated cart dumper prior to receiving powered assistance from the integrated cart dumper.

Another drawback of this type of integrated curb-side cart dumper is that the interior volume of the front-loaded bin is consumed width-wise by the integrating of most of the cart dumper's mechanism into the curb-side part of the intermediate container. The problem is that the container's width is generally limited to a fixed, maximum dimension. The maximum width corresponds to the spacing between the main front-loader arms of the waste-hauling truck. More specifically, when a frontal lift-and-dump-over-the-top operation is carried out, the intermediate container typically has to slip between the front-loader's lift arms as the container is lifted and emptied into the back hopper. The intermediate container may also have to fit width-wise inside the hopper's roof-top opening if the container is to be stowed away in the hopper for long drives. By situating the integrated curb-side cart dumper such that it intrudes into the width-wise limited interior space of the container, the design taught in U.S. Pat. No. 6,123,497 disadvantageously reduces the volume of waste that may be efficiently held inside the intermediate container.

A much more successful design for robotic assistance is seen in U.S. Pat. No. 5,639,201 which issued in 1997 to John D. Curotto. The major part of an extendible robotic arm mechanism is mounted to a front sidewall of an intermediate container. Only a small and flattened-when-retracted, cart-grasping part of the robotic arm fits along the curb-side of the refuse container. Thus the negative impact on the width-wise volume of the container is minimal. Remote controls are provided in the vehicle cab for allowing the driver to automatically and hydraulically extend the robotic arm out from along the front wall of the intermediate container, this causing the arm to extend outwardly (to the right in the USA) to reach a curb-side waste item. Further remote controls are provided for causing the flattened-when-retracted, grasping part of the robotic arm to automatically wrap itself around the waste basket or other refuse item. Another remote actuator automatically causes the robotic arm to rotate about a pivot point such that the arm lifts the waste item and rotationally translates it to a position over an open top of the low-profile, intermediate container. The grasping action of the robotic arm may then be undone so as to dump the waste item into the intermediate container. Alternatively, if an open-top or swivel-top waste basket is used, its contents will naturally empty into the intermediate container as the arm's rotational translation proceeds past a 90 degree rotation point. The robotic arm is then rotated back in the other direction, and if a waste basket is still grasped, the grasping action of the robotic arm may then be undone so as to return the waste basket to a position near its point of origin.

In one embodiment, the intermediate container is a so called, 4-yard bin having a height dimension of about 66 inches and a length of about 56 inches. The robotic arm has a sliding plate mechanism which allows its grasping portion to reach out to the curb a distance of about 60 inches from the right sidewall of the bin and to retract a grasped load about the same distance back toward the bin (the intermediate container). These slide out, grasp, and rotate mechanisms are made sufficiently strong to allow the robotic arm to grab waste baskets having residential refuse volumes in the range of 32-106 gallons. Total cycle time from reach out, to grab, rotate, empty, and return can be as little as about 4 seconds. (Cycle time may vary as a function of reach out distance and other parameters.) The relatively low height of the 4-yard bin allows the truck driver to easily look out his front window and see what is being dumped from the rotated waste basket into the bin while the driver sits reposed in the truck's cab, operating the remote actuators of the robot's slide-out extender, grasper and rotator mechanisms. A screen-like wind-guard at the front of the bin allows the driver to look forward ahead of the bin while keeping in-bin refuse from being easily blown out by air flow. The driver does not need to step out of the vehicle during the collections operation unless he or she spots unacceptable materials being dropped in, in which case he/she may have to manually separate away such unacceptable material. The relatively low height of the 4-yard bin also helps to reduce the amount of energy consumed by the vehicle with each grab, rotate and dump cycle. The low height of the 4-yard bin further helps to reduce the amount of noise made by the vehicle, as the robot arm successively reaches out, grasps, rotates, dumps and returns one curb-side basket after the next while the vehicle drives down a residential street. The volume of the intermediate container is not substantially consumed in the width-wise direction by the front-mounted robotic arm mechanism because a bulk part of the robotic mechanism sits on the front side of the container (4-yard bin). When the full volume of the standard-sized intermediate container is filled, a frontal lift-and-dump-over-the-top may be carried out to make room for additional refuse.

An advantage of having a standard-sized intermediate container rather than an odd-sized one is that fleet-wide management can be simplified. The person who manages fleet-wide equipment deployment may want to calculate the number of times that the frontal lift-and-dump-over-the-top operation has to be carried out per truck and how much fuel will be consumed in doing so. If standard-volume intermediate containers are used throughout the fleet, this should be no problem. However, if intermediate containers with non-standard volumes are mixed into the fleet, it becomes harder to estimate how many frontal lift-and-dump operations will occur per trip through a particular neighborhood and how much fuel will be consumed. This problem is obviated by using a standard-sized, intermediate container where the bulk of the side-loading robotic arm mechanism is mounted to the front of intermediate container.

Despite the success of the front-mounted robotic arm mechanism taught by the U.S. Pat. No. 5,639,201 patent, there is still room for improvement.

INTRODUCTORY SUMMARY

Structures and methods may be provided in accordance with the present disclosure of invention for improving over the above-described designs.

More specifically, in accordance with one aspect of the present disclosure, a side-loading robotic arm mechanism has at least a major portion of its mass (e.g., at least most of its motors, hydraulic pistons and/or piston actuating valves) positioned between the rear, refuse-containing side-surface of a front-loadable refuse container (e.g., intermediate container) and the front cab of the refuse-collecting vehicle. This back positioning is in contrast to having the mass of the robotic arm mechanism being mounted mostly in front of the container while the cab (e.g., the source of power and/or command for the robotic arm mechanism) is situated behind the rear of the container during use. In other words, in accordance with the present disclosure, the center of gravity of the robotic arm mechanism is shifted close to the backside of the container, the backside being where the forks or other retractably engageable lift means (e.g., A-frame) of the front-loading vehicle enter and/or where couplings are made for transmitting power and/or control command signals from the cab to the robotic arm mechanism. An instructing means may be provided for instructing users to introduce their container-lifting forks and/or other retractably engageable lift means from the backside of the container (near the position where the center of gravity of the robotic arm mechanism is situated) rather than through the frontside of the container.

Measures may be taken to assure that the backside-mounted parts of the robotic arm mechanism are situated in front of a hypothetical clearance plane extending vertically up from the back ends of the forks (and/or for being spaced from alike clearance boundaries of other retractably engageable lift means) when the forks (and/or other retractably engageable lift means) are lowered into a trash collecting state such as having the forks leveled parallel to the ground. The clearance-assuring measures may include use of extended or extendible pockets which extend (or can be extended) rearwardly from the fork-liftable container so as to space the intermediate container sufficiently forward to allow the rear-mounted portions of the robotic arm mechanism to safely fit between the vehicle's front cab and the backside of the container. The clearance-assuring measures may alternatively or additionally include use of extended or extendible bumper spacers which extend (or can be extended) by a sufficient distance between the vehicle and the combination of rear-mounted robotic arm mechanism and container to allow the rear-mounted portions of the robotic arm mechanism to safely fit between the vehicle's front cab and the backside of the container. The clearance-assuring measures may alternatively or additionally include use of properly located, fork retaining pins for properly positioning the robotic arm mechanism to be spaced forward of the clearance plane. Such clearance-assuring measures can help to assure that the rear-mounted parts of the robotic arm mechanism will not strike the cab or another such obstacle during a normal, frontal lift-and-dump-over-the-top operation.

Additional measures may be taken to assure that portions of the robotic mechanism which reach out sideways to grab curbside waste items will not strike the fork pistons of the front-loading vehicle during a sideways-out extension operation of the robotic arm. Further measures may be taken to assure that the rear-mounted parts of the robotic side arm mechanism will not be damaged in the event of a "short-dump".

A fork-liftable refuse-grasper and refuse-container combination in accordance with the disclosure comprises: (a) a robotic arm mechanism having a major portion of the mass of its motors mounted on the exterior side of a rear wall of the container; (b) pockets attached to side walls of the container for receiving the forks of a front-loading vehicle, where the pockets extend or are extendible rearwardly beyond the rear refuse-containing wall of the container so as to space the rear-mounted portion of the robotic arm mechanism in front of a hypothetical clearance plane; where the clearance plane extends through rear end points of the forks of the front-loading vehicle when the forks are down close to the ground; and (c) a protective cage extending about at least a portion of the rear-mounted part of the robotic arm mechanism so as to protect the rear-mounted part from short dump or other rear-side collisions. Other protective and/or clearance spacing providing means may be provided as additions or alternatives when the front-loadable refuse bin can be alternatively or additionally lifted by other retractably engageable lift means (e.g., A-frame).

A method for configuring a combination of an intermediate container and a waste-fetching robotic arm in accordance with the disclosure comprises: (a) positioning a major portion of the mass of a robotic arm mechanism behind a rear, refuse-containing wall of the intermediate container; (b) attaching fork pockets to side walls of the container for receiving forks of a front-loading vehicle, where the fork pockets extend or are extendible rearwardly beyond the rear wall of the container so as to space the rear-attached portion of the robotic arm mechanism in front of a hypothetical clearance plane extending through rear end points of the forks of the front-loading vehicle; and (c) protecting at least part of the rear-attached portion of the robotic arm mechanism with one or more protective members so as to protect the mechanism from short dump or other rear-side collisions.

Other aspects of the disclosure will become apparent from the below detailed description.

BRIEF DESCRIPTION OF THE DRAWINGS

The below detailed description section makes reference to the accompanying drawings, in which.

DETAILED DESCRIPTION

Figure 1A:
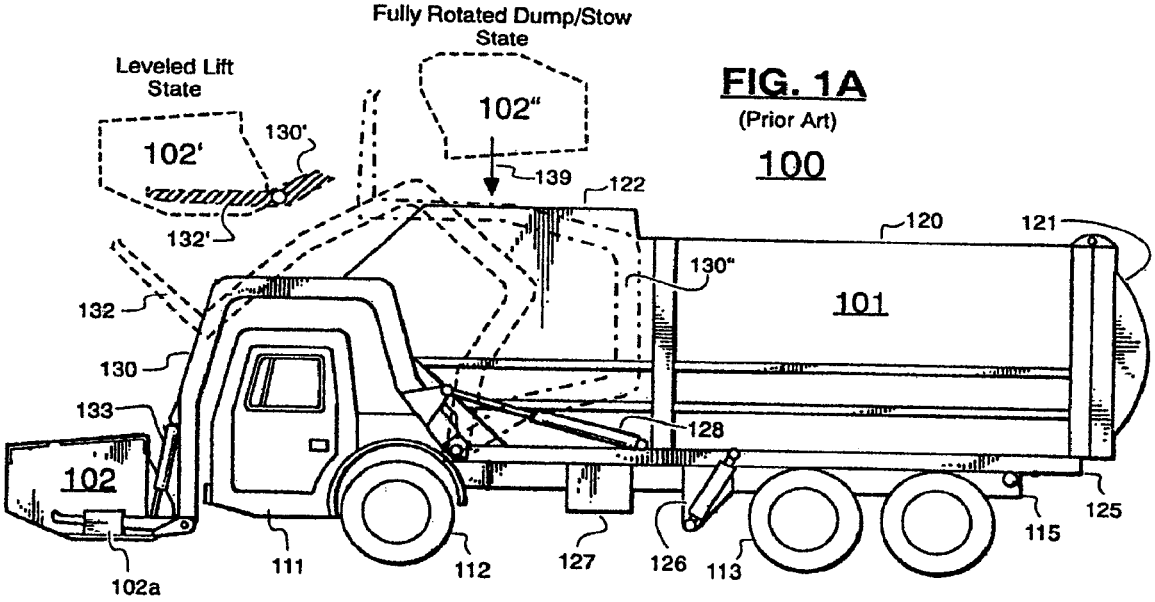
FIG. 1A (Prior Art)
FIG. 1A is a side view of a combination of a conventional front-loading waste-hauling vehicle and a front-loaded intermediate container.

FIG. 1A is a side view of a combination 100 of a conventional front-loading waste-hauling vehicle 101 and a front-loaded intermediate container 102. The depicted elements are not necessarily to scale.

The illustrated vehicle 101 includes at its front an operator's cabin or cab 111 with a front-facing windshield (not shown). It further includes steerable front wheels 112 and load-bearing rear wheels 113. A main structural frame 115 of the vehicle supports a tiltable hopper frame 125. A main, refuse-holding, hopper 120 is supported on the hopper frame 125. The hopper 120 may include a rear-mounted dump door 121, an internal compression means (not shown) for compressing refuse within the hopper, and a top opening 122 for receiving new refuse. A first hydraulic piston 126 is provided on the main structural frame 115 for pivoting the hopper frame 125 (and the main hopper 120) upwardly about the rear end of frame 115, for thereby carrying out a rear-dump operation through back door 121. An appropriate hydraulic fluid drive means 127 is provided on the vehicle 101 for selectively sending pressurized hydraulic fluid to the first piston 126 and/or to other such hydraulic pistons. The hydraulic fluid drive means 127 may include a pressurized fluid reservoir and a return fluid reservoir as well as engine-driven compression means for pumping hydraulic fluid from the return reservoir to the source reservoir (details not shown). A conventional hydraulic system of this type should be capable of providing at least around 10 gallons per minute of pressurized hydraulic fluid at about 2000 psi when the vehicle engine (not shown) is in idle mode.

A second hydraulic piston 128 is provided between the hopper frame 125 and a left-side (street-side) main fork arm 130 for raising and dropping the fork arm 130 (also known as the lift arm) among the various positions shown. It is understood that a similar fork arm and piston are provided on the right side (curbside) of the vehicle and that the left and right fork arms are typically raised and lowered in unison. In one embodiment, a crossbar (130*b* in FIG. 1B) permanently connects the forward ends of the left and right fork arms. Each lift arm 130 is generally shaped as an upside-down letter U. This allows unobstructed egress and ingress into the operator's cabin 111.

A respective and pivoting front fork 132 is provided on the end of each lift arm 130. The left fork is shown in solid as it supports an intermediate container 102 slightly above the ground. More specifically, the left fork is shown as a solid object when the fork is in a forward-extending position inside pocket 120*a* of the intermediate container 102. A fork-pivoting piston 133 is coupled between each arm and its respective fork for selectively pivoting the fork as may be desired. It is to be appreciated from FIG. 1A that the intermediate container 102 can be captured between the left and right forks (only left fork 132 is shown) by sliding the forks into the left and right side pockets of the container (only left pocket 102*a* is shown). Except for the pockets and any structure below them, the rest of the container 102, above and behind the pockets should have a width dimension (measured in the Y direction—see FIG. 2A) that allows the upper part of the container to be easily fit between the left and right fork pistons (133) and between the left and right lift arms (U-shaped arms 130). The fork-receiving pockets 102*a* are conventionally welded to the curbside and streetside side wall exteriors of the container 102 for receiving the left and right front forks 132 respectively. Typically, the intermediate container 102 will first rest on the ground and the operator of vehicle 101 will tilt the forks slightly down while steering the vehicle so the downwardly pointing forks enter rear openings of the pockets. Then, after the tilted forks 132 have been securely introduced into the pockets 102*a*, the operator will level the forks so as to raise the intermediate container 102 above the ground. Metal safety chains (not shown) may then be attached between the back of the intermediate container 102 and the lift arms 130 or forks-joining crossbar (130*b* in FIG. 1B) to prevent the intermediate container 102 from accidentally slipping off the forks. Alternatively or additionally, other safety means may be used to prevent the intermediate container 102 from accidentally slipping off. In some embodiments, the forks have frontal hooks for further assuring that the intermediate container will not accidentally slide off. In some embodiments, the forks and pockets alternatively or additionally have pin holes through which a locking pin (not shown) may be inserted for preventing accidental slide off.

A frontal lift-and-dump operation is schematically illustrated by the sequence of container position states denoted at 102, 102' and 102". Container position state 102' shows the forks (132') pivoted to an obtuse angle relative to arm 130' in order to maintain the intermediate container 102' in an upright position as it is lifted over the driver's cab 111. This leveled lift state (102') is of particular interest to the below disclosure because the weight of the container can present a relatively large moment arm with respect to the pivoting end of the lift arms (130') and with respect to bend points in the U-shape of the lift arms.

When the container is lifted to the height of positional state 102", and positioned above the upper hopper opening 122, the fork pistons 133 may be operated to tilt the intermediate container 102 by about 90 degrees and/or more relative to original state 102 (e.g., into an upside down state) so as to allow a dump 139 of the refuse from the intermediate container 102 into the main hopper 120. FIG. 1A shows the fully rotated state at 102" where the container 102 is upside down. At least part of the container 102 may be stowed away inside of hopper opening 122 by further pivoting the forks and/or rotating the lift arms (state 130"). When the container is stowed, the operator may drive the vehicle 101 without having the front lift arms 130, or the forks 132 or the intermediate container 102 in the way.

Figure 1B:
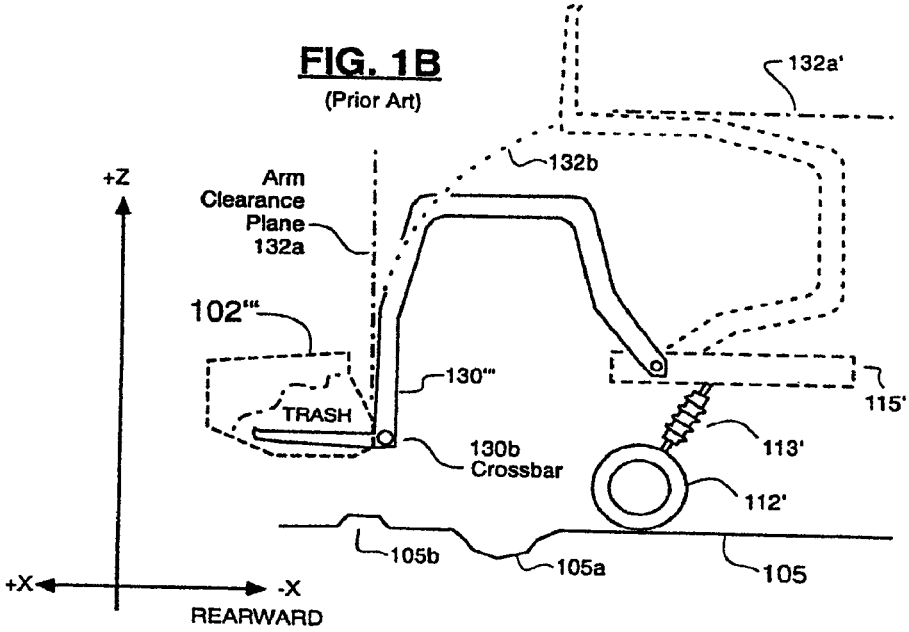
FIG. 1B (Prior Art)
FIG. 1B is a side schematic view showing an expected clearance plane for a frontal lift-and-dump operation.

FIG. 1B illustrates in schematic side-view fashion, some traditional expectations respecting intermediate container 102 and its use. It is conventionally expected that a rearward bottom corner of the intermediate container 102" will abut against a lift crossbar 130*b* provided between the left and right fork arms 130" so that the weight of collected trash will bear against this crossbar 130*b* as a frontal lift-and-dump operation is carried out (lifting the container from its near-roadway state 102 to its dump and/or stow state 102" of FIG. 1A). Often, rubber-like bumpers (not shown) are interposed between the crossbar 130*b* and backside bumper pads (not shown) on the container to absorb shock between the crossbar 130*b* and the intermediate container 102. It is further expected that the intermediate container 102' (FIG. 1B) will be designed so that its entirety remains in front of a hypothetical, arm clearance plane 132*a*. This arm clearance plane 132*a* is maintained through illustrated state 132*a*' so that when the crossbar 130*b* and the rearward ends of the forks move along arc 132*b* (e.g., during a lift and dump operation), the backside of the container 102'" will not collide with the top of the vehicle cab 111 or with the top of the main hopper.

Another expectation that is implicitly represented by FIG. 1B is that the bulk mass of the trash will be kept close to the clearance arc 132*b* during a frontal lift-and-dump operation. This is done in order to minimize the amount of energy expended by the lift-and-dump operation. Extra energy would be wasted if the mass of the trash were lifted higher and/or further out prior to dumping the trash into the main hopper 120 through opening 122.

Yet another expectation that is implicitly represented by FIG. 1B is that the weight of the intermediate container 102'" and its held trash should be borne by the front wheels 112' of the vehicle. Road shocks which may be encountered while the vehicle 101 carries the trash in container 102'" are expected to be absorbed by the front suspension system 113' of the vehicle. More specifically, the roadway 105 may include indentations 105*a* or bumps 105*b* which may cause the vehicle to shake up and down as it drives along. The trash-filled intermediate container 102'" which is supported on the fork-defined ends (132) of the lift arms 130 can act as a cantilevered mass which resonates in response to the mechanical perturbations (e.g., Z-axis shaking). It is expected that the shock absorbing mechanism 113' in the front suspension system of the vehicle will be able to absorb the stress waves that return from the oscillating mass of the container and trash. The lift arms 130'" and their accompanying suspension systems 113' should be designed to handle these kinds of roadway-induced, stresses and strains.

Figure 2A:
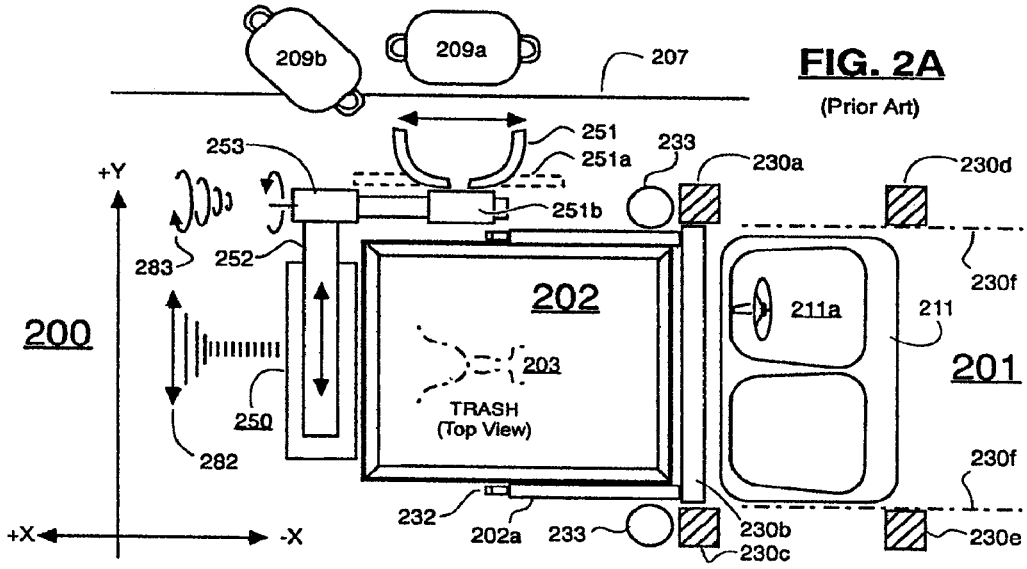
FIG. 2A (Prior Art)
FIG. 2A is a top schematic view showing the operation of an earlier, side-loading robotic arm whose mass is mounted primarily at the front of an intermediate container.

FIG. 2A is a schematic, top plan view of a side-out extending robotic arm configured in accordance with Curotto U.S. Pat. No. 5,639,201. Where practical, like reference numbers in the "200" century series are used in FIG. 2A to denote alike elements which are referenced by corresponding numbers in the "100" century series in FIG. 1A. Reference number 211 a denotes a top view of the glass window behind which the operator sits as he steers the vehicle from the curbside of the operator cab 211. Square boxes 230*a*, 230*c*, 230*d* and 230*e* schematically represent the cross-sections of the upside down U-shape of the main lift arms. Intermediate container 202 is preferably a low profile container which is situated to allow the driver to look through window 211*a* and see what kind of trash 203 is being deposited into the intermediate container 202 by robotic grasper 251 after rotation by rotator mechanism 253.

The top view shows the lift-arm crossbar 230*b* extending between the left and right side cross-sections (230*a*, 230*c*) of the main lift arms. Circles 233 represent cross-sectional parts of the fork-pivoting pistons (see 133 of FIG. 1A). The side-out extendable robotic arm mechanism 250 is seen to define an essentially L-shaped contour from the top view, where the L-shape fits snuggly along the right side of the intermediate container 202 (along the curbside near curb 207) and where the L-shape further occupies a space in front of the container 202. (The front is in the +X direction.)

FIG. 2A shows the robotic arm 250 in a configuration where its grasper 251 is slightly extended-out towards the curb 207 due to a reciprocate-out action by a motorized reciprocating member 252. This partially extended-out state is shown for providing a quick understanding of some of the operations of the robotic arm. When the robotic arm mechanism 250 is in a fully retracted mode, grasper 251 opens to lie essentially flat alongside the curbside of the intermediate container 202. (See also the perspective arrangement of the embodiment of FIG. 2C). The flat-when-retracted state 251*a* of the grasper 251 allows the combination of the container body 202 and the robotic arm mechanism 250 to clear the interior clearance lines 230*f* of the left and right main lift arms 230*a*, 230*c*-230*e*. In one embodiment, the waste-grasping portion 251 of the robotic arm has symmetrically opposed first and second digits which can be worked under remote control of the vehicle driver (in cab section 211*a*) like an articulating hand so as to grasp a sidewalk basket 209*a* or 209*b* irrespective of the top view orientation of the waste basket. Dashed item 251*a* schematically represents the grasping digits 251 in the ungrasp state, where they form an essentially flat profile that can lay flush against the exterior of the curbside wall of intermediate container 202. A first motor means 251*b* is provided with appropriate hydraulics for causing the grasper digits 251 to close on an object and grasp it, or to open and flatten into state 251*a* for flush retraction against the container's right sidewall as appropriate.

The side-out robotic mechanism 250 further includes, as already mentioned, a motorized reciprocating member 252 (e.g., hydraulically driven) that reciprocates in the Y direction for causing the grasper 251 to translate out towards the sidewalk 207 to grab a waste basket 209*a* and to bring the waste basket 209*a* (or other waste-containing or waste item) back towards proximity with the intermediate container 202. The corresponding motor means (e.g., hydraulic piston) for causing Y direction reciprocation is provided on the front side of the intermediate container 202 and coupled to both the container front wall and the reciprocating member 252 (e.g., a slide plate on roller wheels).

Finally, the robotic arm mechanism 250 includes a motorized rotating mechanism 253 which provides rotation about a line parallel to the X axis. After the reciprocating member 252 reciprocates items 253 and 251 outwardly so that grasping fingers 251 can be actuated to grasp the waste basket 209*a*, the rotating mechanism 253 may be actuated to bring the waste basket (or other waste item) over the top of container 202 for dumping of the trash 203 into the interior of container 202. Retraction by reciprocating member 252 can occur at the same time as rotation by the rotating mechanism 253 so as to provide a distributive dumping effect. (If at the time of rotation over the top 202 of the container, the grasper 251 holds a waste item rather than a filled waste container, the grasper may be switched into the ungrasping mode in order to drop the waste item into the container.) The operator (211*a*) is able to observe the trash as it is being dumped into the container 202 through the cab's window 211*a*.

After the refuse parts of the rotated waste item 209*a* are emptied, the robotic mechanism 250 may be run in reverse to return the wastebasket 209*a* (if any) to a point near its original position on the curb 207 and to release it from the grasp of robotic digits 251. The vehicle 201 may then be driven slightly forward (e.g., in the +X direction) so as to align the grasper 251 for reach out to the next sidewalk waste basket/item 209*b*. The same robotic action may then be quickly carried out again by extending member 252 out towards the sidewalk and activating hand 251 to grasp the second waste item 209*b*, and further activating rotator 253 to begin rotating the second waste item 209*b* to bring it in over the interior opening of the intermediate container 202. For the sake of avoiding illustrative clutter, hydraulic lines and electrical connection cables are not shown extending from the cab 211 of the main vehicle 201 to the robotic mechanism 250. They are nonetheless understood to be present. See the embodiment of FIG. 2D. Therefore it is to be understood that power and command signals flow from the region of cab 211, around the intermediate container 202, and to the front-mounted robotic arm mechanism 250.

Figure 2B:
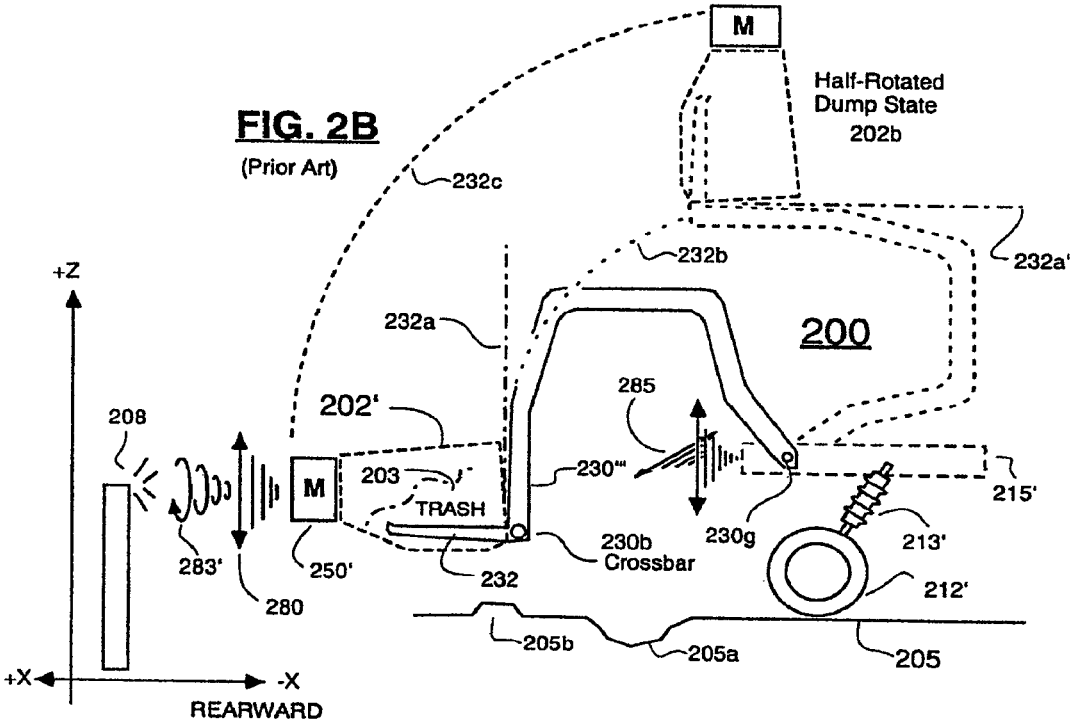
FIG. 2B (Prior Art)
FIG. 2B is a side schematic view showing the operation of the earlier, side-loading robotic arm whose mass is mounted primarily at the front of the intermediate container.

Although the front-mounted robotic arm mechanism 250 of FIG. 2A works very well, there is till room for improvements. FIG. 2B provides a schematic side view which may be combined with the top view of FIG. 2A for better understanding of how some of these improvements may be manifested.

It may be observed from FIG. 2B that the bulk of the mass (M) of the robotic arm mechanism is situated at the front end of the intermediate container 202' as represented by rectangle 250'. This schematically represented mass M may be thought of as a mass at the end of a springy cantilevered beam. When a truck wheel 212' strikes an uneven section of roadway (205*a*, 205*b*), the shock is transmitted forward from lift arms 230''', through the intermediate container 202' and to the bulk mass (M) of the robotic arm mechanism 250'. In response, the bulk mass (M) shakes up- and down as is indicated by reciprocation symbol 280. Non-interfering Z-axis reciprocations may travel back through the intermediate container 202' and through the forks 232 to create strain moments which may stress the forks 232, the lift arms 230''' and/or the suspension 213' of the vehicle. Because there can be a relatively long moment-arm between the pivot point 230*g* of the lift arms 230''' and the bulk mass (M) of the robotic mechanism 250', the effects of the front end vibrations (e.g., Z-axis oscillations 280) may become amplified and they may can cause damage to the lift arms 230''' and/or to the vehicle suspension 213'. Thus if a way could be found to reduce the effective mass and/or the effective cantilever length of the mass-beam system, the danger of such vibrations can be advantageously reduced.

When the robotic arm extends out to the curb (207 in FIG. 2A) and begins to rotate a heavy waste basket/item (e.g., 209*a*) upwardly, there is also a danger that a relatively large torque arm could be generated about the X-axis because of the extent of the robot's reach and the possibly large weight of the rotating waste item (209*a*). In other words, the rotating waste basket/item 209*a* can represent a mass at the end of yet another cantilevered beam. Torquing oscillations may ensue in certain situations. Such rotational torques (represented as 283/283' in FIG. 2A/2B) can also be additively amplified under certain circumstances when transmitted backwardly (in the −X direction) through the intermediate container 202', through the forks 232 and into the lift arms 230''' and/or into the vehicle suspension system 213'. The effects of such unusual front-end torquing 283 might cause damage to the lift arm 230 and/or to the vehicle suspension 213'. Thus if a way could be found to reduce the effective transmission paths for such torquing moments 283', the dangers of additive shearing stresses could be advantageously reduced.

When the Y-axis reciprocator 252 reaches out or retracts back, various, non-interfering Y-axis oscillations 282 may develop additively under certain circumstances, this depending on spring mass factors and speeds of reciprocation. These Y-axis oscillations 282 may also be additively amplified as they are transmitted backwardly through the intermediate container 202, the forks 232 into the lift arms 230''' and/or into the vehicle suspension system 213'. Symbol 285 represents the combined effects of the various linear and/or rotational forces that may reflect back through the forks and into the lift arms and/or vehicle body as a result of operating the front-mounted robotic arm 250 and/or driving the vehicle with the combination of the front-mounted robotic arm 250 and the more rearward container 202'. Under certain circumstances, the combined effects 285 of these various stresses and strains may interfere with proper operation of the lift arms 230''' and/or vehicle 201. Thus if a way could be found to reduce the effective transmission paths for such Y-axis reciprocation stresses 282, the dangers of additive reciprocation stresses could be advantageously reduced.

Consider next, what happens during a frontal lift-and-dump operation. The mass (M) of the front-mounted robotic arm mechanism 250' is often lifted higher than any other component of the intermediate container 202' during such an operation. See arc 232*c* in FIG. 2B. This means that extra energy is exerted for raising the mass (M) of the robotic arm mechanism 250' up against gravity. By contrast, the centers of gravity of the trash 203 and of the intermediate container 202 ride closer to the cab clearance arc 232*b*. It may appear on first blush that this is the better way to arrange the components since the mass of the trash 203 can be fairly large. However the mass of the trash 203 is not consistently large and it is not consistently packed in a dense manner. There are many times when low density (low mass) refuse is collected or when the container 202' is lifted or lowered while it is empty. Very often, the container will be empty when it is lowered after a dump or stow-away operation. (Hydraulic energy is consumed for lowering the combination of the container 202' and the front-mounted robotic arm 250' as well as for raising it). Accordingly, it may be seen on second thought that the mass (M) of the front-mounted robotic arm mechanism 250' is consistently present. The constantly-present and densely-packed mass (M) of the robotic arm mechanism 250' may subject the lift arms 230''' to a whipping action as state 202*b* is reached at the end of a rapid frontal lift-and-dump operation. Also, the positioning of the robotic center of mass (M) at or near the front of the intermediate container 202' may waste significant energy (particularly because the trash container is usually empty during a lowering operation). Thus if a way could be found to reduce the possibility and/or effects of such a whipping action and/or less-than-optimal expenditure of energy, a better system may be obtained.

Consider next the possibility that the driver (in cab position 221*a*) may fail to see a low-lying obstacle 208 such as a parking post when steering the truck 201 about in a tightly constrained driving area. If a collision occurs with the obstacle 208, it may result in costly damage to the hydraulic valves and/or other parts of the front-mounted robotic arm 250'. Thus if a way could be found to reduce the possibility of such collision damage to the robotic arm mechanism 250', a better system may be obtained.

Consider next, that the driver's view of the front-mounted part of robotic arm mechanism 250', as seen from cab position 211*a*, might be obstructed by the intermediate container body 202' which is interposed between the vehicle cab 211 and the robotic arm mechanism 250'. If a hydraulic hose springs a leak or gets snagged with another item, or if a mounting bracket starts to come loose due to wear and tear, the driver may not be able to quickly spot such problems as they first arise. The interposed intermediate container 202' may obstruct the sighting of such problems. The cost of repair and/or loss of hydraulic fluid may have been reduced if only the driver had seen the problem earlier. Thus if a way could be found to improve the visibility of such emerging problems when they first become detectable, a better system may be obtained.

Figure 2C:
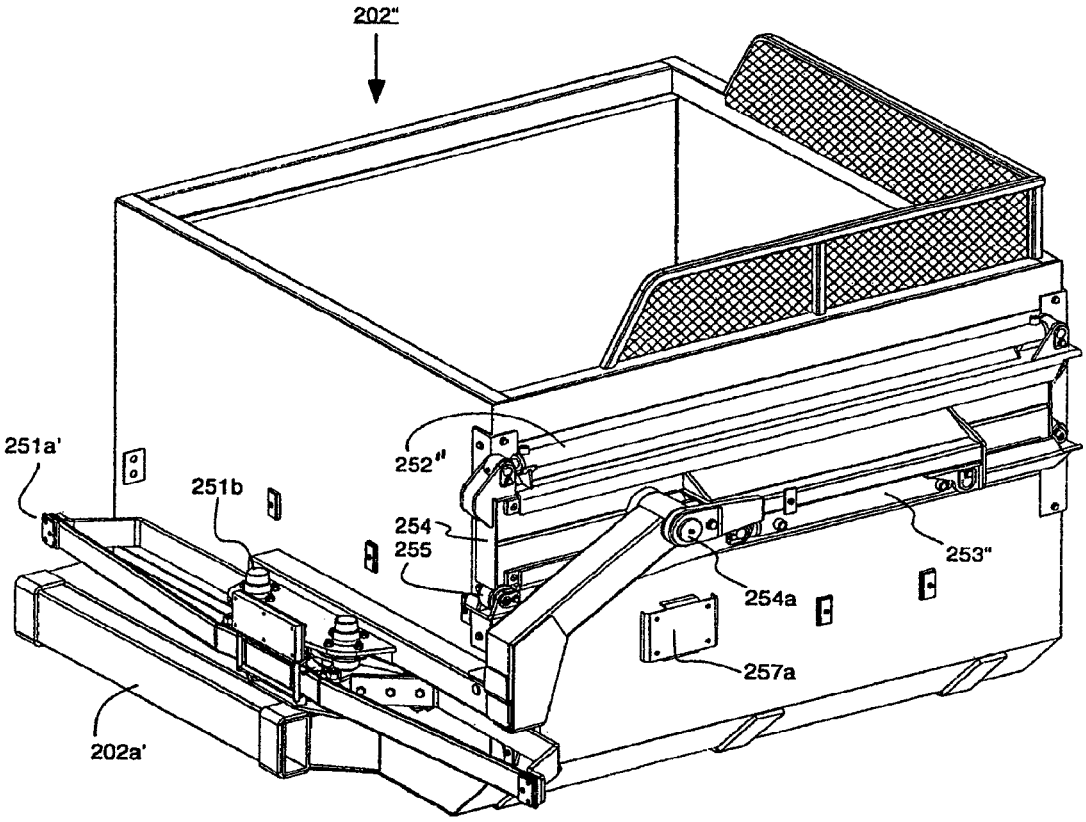
FIG. 2C (Prior Art)
FIG. 2C is a more detailed perspective view of one embodiment of the earlier, side-loading robotic arm whose mass is mounted primarily at the front of the fork-liftable bin.
Figure 2D:
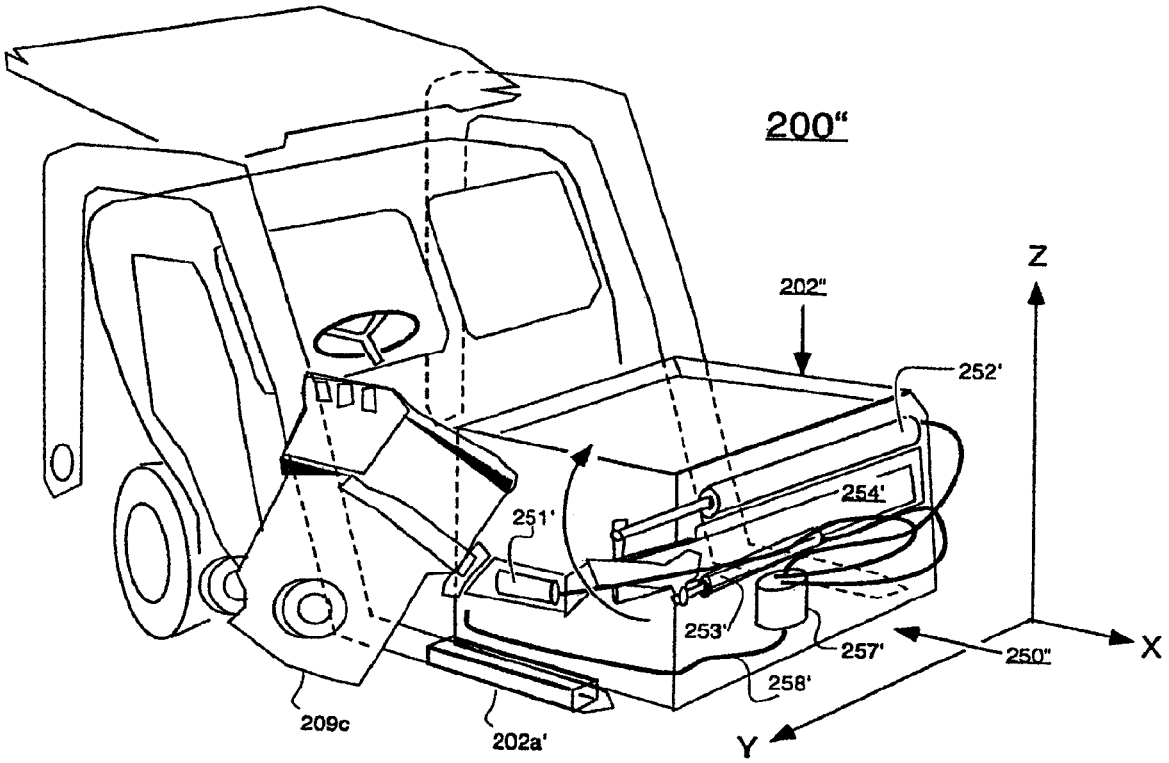
FIG. 2D (Prior Art)
FIG. 2D is a schematic perspective view showing the embodiment of FIG. 2C in action, where power and command originate from the steered collections vehicle.

FIGS. 2C and 2D provide perspective views of one particular embodiment 200" in which a majority portion of the mass of a robotic arm mechanism is mounted to the front side of an intermediate container 202". In FIG. 2C, item 254 is a reciprocating plate which rides linearly out on rollers such as the one shown at 255. Linear piston 252" propels the sliding plate 254 out towards the curbside and then back in. A second piston 253" rides on the sliding plate 254 and is used for rotating the grasper portion 251*a*' of the arm around pivot point 254*a*. (Pivot point 254*a* resides on the slider plate 254 as does piston 252'''.) A grasper-actuating piston resides below, and connects to scissor ends 251*b*. The grasper-actuating piston (not directly seen in this perspective view) expands to close the grasper digits 251*a*' and contracts to switch the digits into an ungrasp mode. Side pocket 202*a*' extends from being flush with the container backwall towards the front of the intermediate container 202" so that the pocket 202*a* ends about two-thirds of the way towards the front of the intermediate container (towards the side wall that holds a hydraulic valves, mounting bracket 257*a*).

In the schematic view of FIG. 2D, a curb-side waste item 209*c* is seen in a partially rotated orientation. A control section 257' of the robotic arm is mounted (bracket 257*a* of FIG. 2C) on the front wall. The control section 257' receives a flexible cable bundle 258' from quick dis/connect joints provided near the front cab of the illustrated garbage truck. The cable bundle 258' includes at least a high-pressure hydraulic source hose, a low-pressure hydraulic fluid return hose and an electrical cable for carrying electrical signals. The electrical signals may come from a remote control console mounted within the driver's cab and/or positioned elsewhere for allowing the operator to conveniently actuate the robotic mechanisms of the robotic arm mechanism 250". Within controls unit 257' of the illustrated configuration there are at least six (6) electrically controlled, hydraulic valves which are operatively coupled to the extension and retraction piston chambers of the three (3) robotic arm hydraulic actuators. Element 254' represents the slide mechanism which is hydraulically reciprocated in the Y direction. Rotation actuator 253' rides together with the rest of the robotic arm on slide mechanism 254'. Piston 251' operates the grasping and ungrasping motions of the robotic digits. Hydraulic and/or electrical cables extend from the main control unit 257' to various portions of the robotic arm mechanism as is generally shown in FIG. 2D.

Figure 3A:
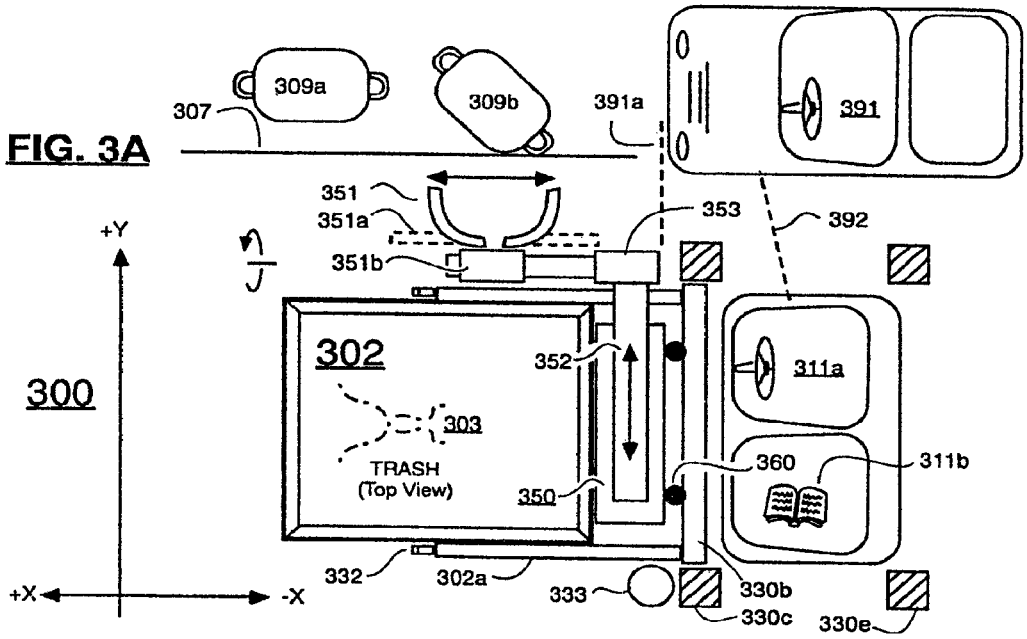
FIG. 3A is a top schematic view showing the operation of a side-loading robotic arm whose mass is mounted primarily at the back of an intermediate container in accordance with the present disclosure.

FIG. 3A is a top schematic view of an intermediate container 302, a robotic arm mechanism 350, and a control cab 311*a* positioned in the recited order so that, according to the present disclosure, the majority of the mass of the robotic arm mechanism 350 is interposed between the back, refuse-containing side-surface of the intermediate container 302 and the control cab 311*a*. The illustrated control cab 311*a* may be taken to represent the source of energy for supplying hydraulic and/or other energy to the motors of the robotic arm mechanism 350. Alternatively or additionally, the illustrated control cab 311*a* may be taken to represent a possible source of remote control signals for timely activating the motors of the robotic arm mechanism 350 so as to cause the robotic arm mechanism to perform various action sequences. Although not explicitly shown, the control means (311*a*) for controlling the robotic arm mechanism may be constituted by a joy-stick box or the like which operatively coupled to appropriately controllable parts of the robotic arm mechanism (350) by wire or wireless means including radio-frequency coupling and/or optical (e.g., infrared) coupling such that an operator can situate himself or herself safely behind the robotic arm mechanism 350 (be it in the cab or standing just outside the cab) while controlling its robotic actions. In one embodiment, side-to-side actuation of the joystick causes at least one part (e.g., 352) of the arm to move correspondingly in the +Y and −Y directions. Forward and back actuation of the joystick causes at least another part (e.g., 353) of the arm to rotate grasping digits (351) of the arm toward and away from the top interior area of the intermediate container (302). Toggling of a top button on the joystick causes a grasping part (351*b*) to switch between a waste grasping mode and an ungrasped mode (e.g., open-hand mode). An intuitive interface is thereby provided for allowing the operator to easily control motorized operations of the robotic arm mechanism.

Where practical like reference numbers in the "300" century series are used for elements of FIG. 3A that have counterpart elements in the "200" century series in FIG. 2A. It may be readily seen therefore that the robotic arm 350 of FIG. 3A is essentially a rear-mounted, mirror image of the front-mounted robotic arm 250 of FIG. 2A.

Figure 3B:
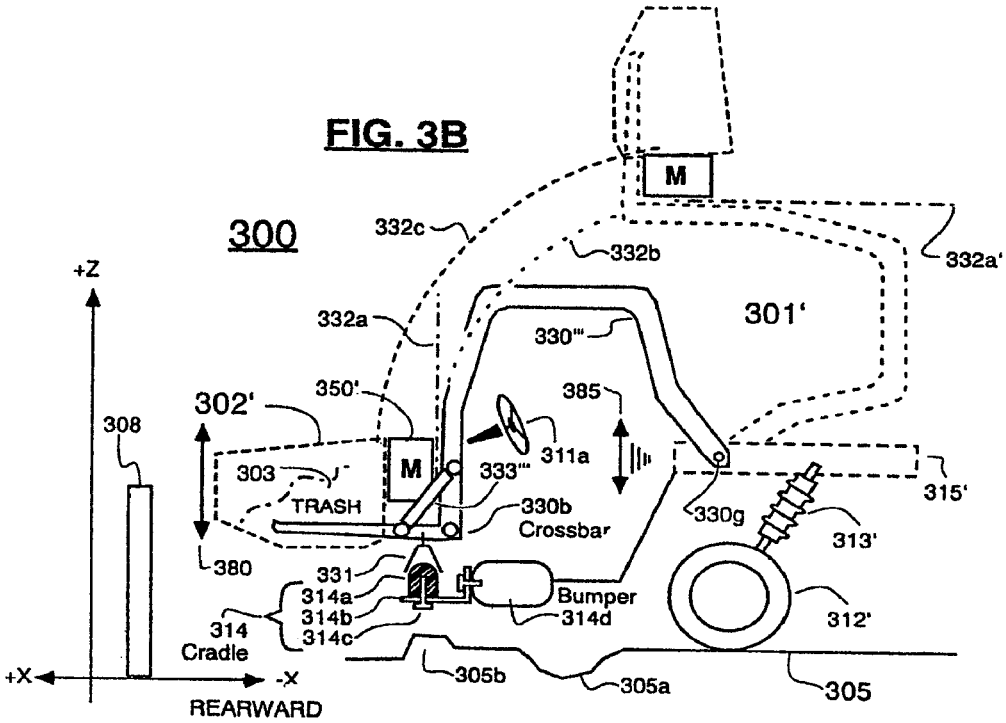
FIG. 3B is a side schematic view showing the operation of a side-loading robotic arm whose mass is mounted primarily at the back of a fork-supported intermediate container in accordance with the present disclosure.

The side view of FIG. 3B schematically shows that a substantial portion of the mass (M) of the robotic arm mechanism 350' is mounted on the exterior side of the refuse-containing backwall of refuse container 302 or that it is otherwise so-positioned so that at least a majority of the mass of the motors and/or of other parts of the robotic arm mechanism are interposed (as seen when projected along the X-axis) between the back of the intermediate container 302' and the operator's cab 311*a*'. The mirror-image robotic mechanism 350 is configured so that reciprocating member 352 can unobstructedly reciprocate out to the curbside 307 of the vehicle and back for translating grasping digits 351 into grasping orientation with a curb-side waste item/basket (e.g., 309*a* or 309*b*) and for returning grasped waste baskets (e.g., emptied ones) to desired return positions along the curbside 307.

Element 353 represents the motor-powered (e.g., hydraulic) rotating mechanism which rotates the grasper forearm (not explicitly shown in FIG. 3A, see extension from hinge 254*a* of FIG. 2C) and thereby arcs a grasped waste item (e.g., 309*b*) towards an open area above the trash-receiving interior of the intermediate container 302. A so-arced waste item and/or its contents may then be dumped into the interior of the intermediate container 302 by executing an ungrasp action with motor means 351*b*.

Because the bulk of the mass (M) of the robotic arm mechanism 350 has been brought rearward, closer to fulcrum point 330*g*, many of the problems associated with having a densely-packed mass suspended at the end of a long cantilevered beam have been are reduced. For yet better results, bumper cradles 314 are added to the vehicle 301 and a bumper-engaging coupling 331 is added to the front of the crossbar 330*b* or to the bottom of the rear-mounted robotic arm mechanism 350'. In one embodiment, each of the bumper cradles 314 (there should be at least two mounted on opposed left and right ends of the vehicle bumper 314*d*) includes a dome-shaped projection 314*a* made of an elastomeric material (e.g., rubber or neoprene) which is adjustably fastened by a bolt 314*c* or other adjustable means to a bumper L-plate 314*b*. The bumper L-plate 314*b* is fastened to the front metal bumper 314*d* or another frame member of the vehicle 301'. Bumper 314*d* (or the other frame member) rigidly couples to the frame 315' of the vehicle 301'. The adjustable fastening means (e.g., bolt 314*c* in an elongated slot—not shown—of plate 314*b*) is structured so that the bumper projection 314*a* can be aligned to the bumper-engaging coupling 331. In one embodiment, the bumper-engaging coupling 331 is frusto-conically shaped to ride on top of the hemispherical top portion of elastomeric dome 314*a* and to engage with the dome 314*a* with some degree of misalignment tolerance as the lift arms 330''' are lowered into a trash-collecting height. The bumper-engaging coupling 331 may be fixedly coupled, or swivel-wise and elastically coupled to the front of the crossbar 330*b* or to the bottom of the rear-mounted robotic arm mechanism 350'.

Other cooperating shapes may be used for the combination of the bumper-engaging coupling 331 and the elastomeric projection 314*a* besides bell and dome. For example, the bumper bracket 314*b* could be cup shaped and lined on its interior with elastomeric material while the bumper-engaging coupling 331 could instead be ball-shaped to fit into and ride inside the elastomerically-lined cup. The order of where the elastomeric material resides and where the bumper-engaging coupling resides can be reversed or other wise rearranged. For example, the elastomeric material may instead ride in bell 331 while projection 314*a* becomes a metal ball to fit ball-in-socket fashion into the elastomerically-lined bell (331). Elastomeric material may be provided both in the portion that rides on the vehicle bumper 314*d* and the portion of the cradle mechanism which moves with the forks. The end result is that stresses and strains from various shakings of the robotic arm mechanism 350' can be absorbed and attenuated by the elastomeric material 314*a*. Moreover, the beam-length of the cantilevered mass (M) is shortened because now the cradle regions 314 become the fulcrum points for torquing moments due to the mass (M) of the robotic arm mechanism 350' rather than the more-rearward ends 330*g* of the lift arms 330'. As such, when the lift anus lower portion 331 into resting engagement with projection 314*a*, the mass of the back end of the vehicle 301' comes into play for countering the thrusts of reciprocations and rotations of the robotic arm mechanism 350. Elastomeric material 314*a* absorbs part of the energy of road shocks (e.g., due to bumps 305*a*, 305*b*) and there is therefore less stress on the forks 332, the fork pistons 333''', the lift arms 330''' and the vehicle suspension system 313'. The elastomeric material 314*a* may be omitted and there would still be the advantage of placing the fulcrum point closer to mass (M) 350' rather than back in the area of arm hinge 330*g*. If the elastomeric material 314*a* is kept, it does not have to provide shock absorption on a 3-dimensional basis (X, Y, Z, and rotational torques). Advantages could be had simply from absorbing Z direction forces and/or Y direction forces. Typically, some −X direction absorption of shock can be provided by the crossbar bumpers that are normally included with intermediate containers. (See FIG. 4A for a more detailed description of crossbar bumpers.) While the embodiment 300 of FIG. 3A utilizes fork receiving pockets 302*a* for receiving the retractably engageable forks 332, other retractably engageable lift means (e.g., A-frame approach) may alternatively or additionally be used without departing from the scope of the present disclosure. Thus, the fork-based configuration of FIG. 3A should not be seen as limiting the broader aspects of the disclosure. An A-frame approach will be disclosed below in conjunction with FIG. 7.

Referring still to FIG. 3A, a few items may not be readily apparent from first glancing at the drawing. First, the fork-receiving pockets 302*a* of this embodiment are extended substantially rearward (in the −X direction) of the main body of the intermediate container 302 and they terminate before reaching the front so as to discourage fork-insertion from the front side of intermediate container 302. The rearward extension (e.g., at least 10 inches) of fork-receiving pockets 302*a* helps to ensure appropriate clearance from the lift arm crossbar 330*b* and/or arm clearance plane (332*a* in FIG. 3B) so that mass portion 350' of the robotic arm mechanism can be safely mounted interposingly between the rear of intermediate container 302' and the front of the operator's cab (311*a*). The rearward extension of the fork-receiving pockets 302*a* also allows the cab operator to easily see his or her way into inserting the forks (332) into the fork-receiving openings of the pockets 302*a* even though the robotic arm mechanism 350' is mostly mounted on the same backside of the intermediate container 302. Conventionally, a cab operator expects to have the crossbar bumpers (not shown—see FIG. 4A) engage against a flat, unobstructed side of a refuse container. However, in the present case (FIGS. 3A-3B) where the bulk of the robotic arm mechanism 350' is to be interposed between the crossbar clearance plane 332*a* and the back wall of the intermediate container 302, it may be helpful to provide the cab operator (who sits in area 311*a*) with instructing means 311*b* which instructs a reader to insert the forks (332) in from the side where the bulk of the robotic arm mechanism 350' is situated. FIG. 3A schematically shows the instructing means 311*b* as an instruction booklet which may be included with one or more of container 302 and robotic arm mechanism 350' when they sold to users. However alternative or additional instructing means are within the contemplation of the present disclosure. The instructing means could include an interne website with appropriate instructions or other forms of signal download from a source, where the download signals are manufactured and include indications of how to insert the forks from the backside of the intermediate container and/or how to connect power and/or control lines from the collections vehicle to the backside-situated, robotic arm mechanism. The instructing means could include an audio tape with recorded verbal instructions to this effect, they could include facsimile machine signals and/or they could include telephone signals that are manufactured for the purpose of conveying such instructions to a recipient.

Another aspect of FIG. 3A which may not be readily apparent is that an optional protective cage 360 extends on the rearward side of the robotic arm mechanism 350 to protect that rearward side from "short-dumps" or other such unintended collisions. The darkened circles 360 in FIG. 3A schematically represent cross sections of some of the bars of such a protective cage.

There are a number of further advantages to the rear-mounting of the robotic arm mechanism beyond that of shortening the cantilevered beam length to which the robotic mass (M) attaches. First, in FIG. 3A it may be appreciated that the driver in compartment 311*a* may have a better line of sight 392 to obstructions such as curb-side parked car 391. The closeness of the Y-direction reciprocating member 352 to the driver (e.g., less than about 6 feet) may help the driver to better estimate when the side-out reciprocating member 352 is clear of the front of the car 391 for safely extending out to grasp a nearby waste item 309*b*. Moreover, the driver in compartment 311*a* may have a better line of sight to the back-mounted components (e.g., 352) of the robotic arm mechanism. Thus, if a hydraulic hose connection is beginning to spring a leak, or a screwed-on bracket is starting to come loose, or an electrical motor is starting to smoke, perhaps due to a frozen bearing, the driver has a better chance of spotting such onsets of a problem and of taking quick corrective action. This is an improvement over the counterpart situation where such items were mounted on the front of the intermediate container. In accordance with the disclosure, one or more of hydraulic hose couplings, electrical cable couplings, motor means, and critical moving mechanical parts (e.g., the Y-direction reciprocating member 352) are mounted close to the top and back of block area 350' (FIG. 3B) so that the driver can more easily spot visually identifiable problems with such elements.

A further advantage of having the robotic arm mechanism 350' close to (e.g., within 6 feet or less of) the front of the collections vehicle 301' is that the lengths of connection hoses between the truck 301' and the main hydraulic control valves (not shown—see 257' of FIG. 2D) can be made shorter (e.g., less than about 6 feet long) than was possible when the valves were mounted in the front of the intermediate container.

Referring to the side schematic view of FIG. 3B, it may be further appreciated that the danger of the robotic arm colliding with a low profile parking post such as 308 or other such objects is now eliminated. Moreover, when a frontal lift-and-dump operation is carried out, the travel arc 332*c* (FIG. 3B) of the robot's bulk mass 350' (M) has a smaller radius and therefore less energy is expended in lifting the mass (M) than would have been had the main mass been mounted at the front of the trash container 302'. Whipping energy at the top of the arc is reduced. It may be appreciated that the trash 303 in intermediate container 302' also has its own mass and that this moving mass has its own energy. However, the mass of the trash 303 is loosely packed rather than being solidly packed as is the main mass 350' of the robotic arm mechanism. Also the mass of the trash 303 is not always present whereas the main mass 350' of the robotic arm mechanism is constantly present, even if the intermediate container 302' is empty of trash. Thus, the main mass 350' of the robotic arm mechanism has a more pervasive effect on the stresses applied to the lift arms 330 and on the energies expended by the waste-hauling vehicle 301 in carrying out controlled lifts or lowerings of the combination of the intermediate container 302' and the robotic arm mechanism 350'.

Still referring to FIG. 3B, it may have been thought that the fork-pivoting pistons 330" pose an obstructing problem for the back mounting of the robotic arm mechanism 350'. However, as seen in FIG. 3B, the robotic arm mechanism 350' may be mounted high up or otherwise on the back wall of the intermediate container so that its Y-directed reciprocating portion 352 clears the curbside fork piston 333'. In one embodiment, the fully-ungrasped state 351*a* of the grasping digits 351 spreads the digits out in a relatively wide lateral orientation. The clearance spacing provided by the backward extending pockets and/or by other spacing means should be sufficiently large for the spread digits 351*a* of this spread-open-wide embodiment to clear the curbside fork piston 333. There should be no problem therefore with having hydraulic valves and/or electronic control subsystems situated lower down on the container backwall and between the streetside and curbside fork pistons 333" because the valves and electronics do not need to reciprocate out in the Y direction. It is to be understood that the problem of clearing the fork piston 333" on the reach-out side may not exist in alternate, forkless embodiments where other retractably engageable lift means (e.g., A-frame) are used. Moreover, the grasping digits 351 may alternatively be configured in an asymmetric design where the digits closer to the fork piston 333" are shorter than those further away.

Figure 4A:
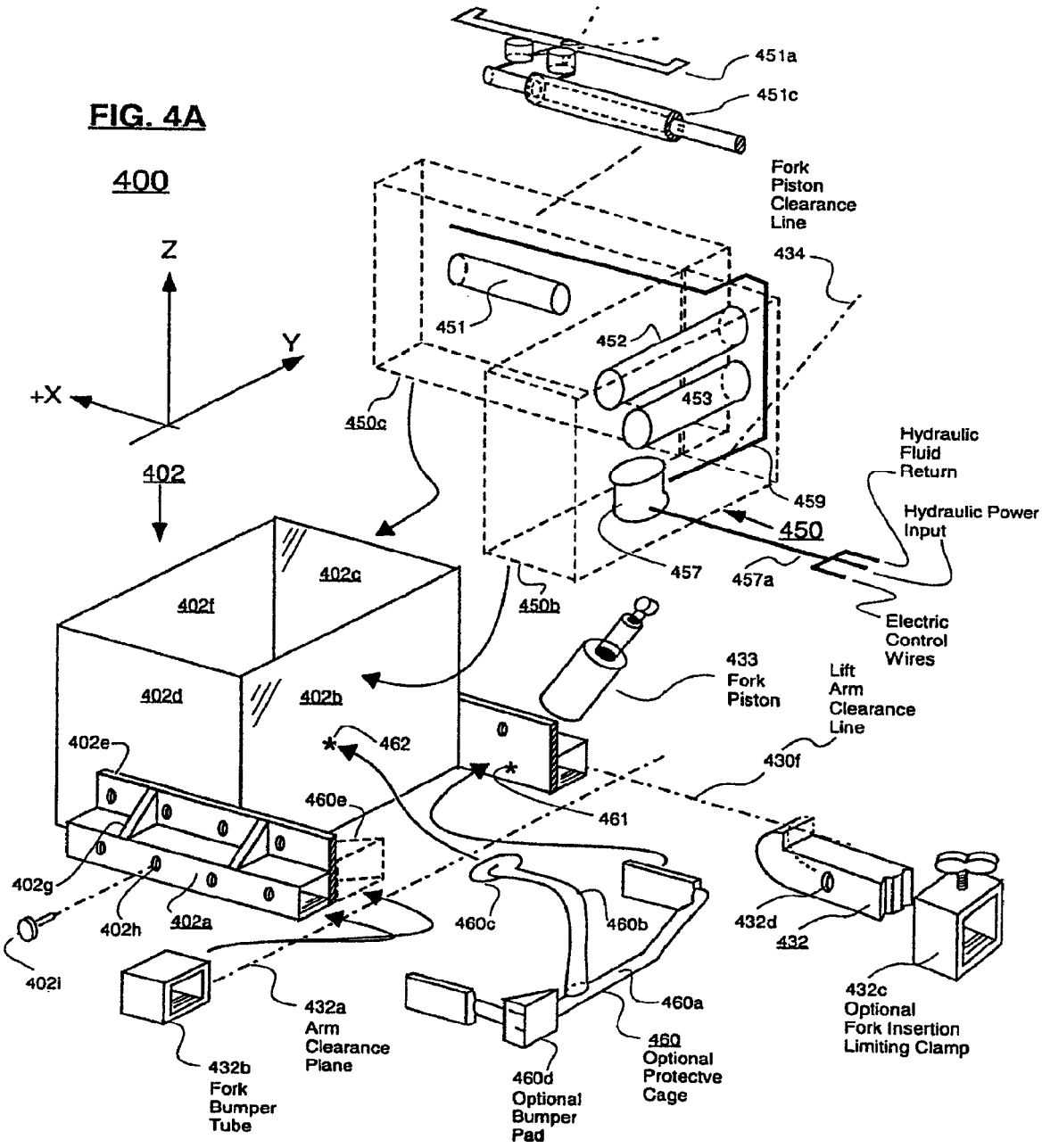
FIG. 4A is a schematic and exploded perspective view showing how a substantial portion of the mass of a robotic arm mechanism can be mounted to the back of a refuse-containing wall of a fork-liftable bin.

FIG. 4A is a perspective schematic diagram with some parts exploded away to show one possible configuration 400 for integrating a fork-liftable, intermediate container 402 and a robotic arm mechanism 450 which has most of its mass mounted at, or otherwise situated near, the rear of the intermediate container. As can be seen, the fork-receiving pockets 402*a* have been extended rearwardly and they have been reinforced (e.g., with side bracket 402*f* and top ribs 402*g*) so as to be able to support the weight of the intermediate container (with contained refuse) during a fork insertion operation. The backwardly extended pockets 402*a* should be reinforced to safely support the additional weight of the robotic arm mechanism even though the full lengths of the pockets 402*a* are not welded to the sidewalls 402*c*-402*d* of the container 402. The illustrated, reinforcing side bracket 402*e* may be bolted and/or welded and/or otherwise fastened to the main body of the intermediate container 402. Fixed fastening is not required. The pockets 402*a* can be made to be variably extendible to desired distances rearward of the intermediate container 402. This may be done by use of plural mounting bolts being provided to extend outwardly from the curbside and streetside sidewalls of the intermediate container and by the use of evenly space holes in the reinforcing side brackets 402*e* for removable fastening to the protruding side bolts (or other latching means) so that users can adjust the distance of rearward extension of the fork-receiving pockets to provide appropriate clearance room for the back-situated part 450*b* of the robotic arm mechanism 450 and/or for other devices that might be interposed between the arm clearance plane 432*a* and the back side wall 402*b* of the intermediate container 402.

Although each of the reinforcing side brackets 402*e* are shown as attaching to a respective one of the exteriors of the streetside and curbside walls (refuse-containing walls) 402*d* and 402*c*; and even though the pockets are shown as each extending the full length of, and being welded to or otherwise fastened to the exterior surfaces of the side brackets 402*f*, a wide variety of other options are available for spacing the back wall 402*b* of the intermediate container away from the front of the collections vehicle (not shown) so that the back-situated part 450*b* of the robotic arm mechanism 450 can be safely interposed between the front of the vehicle and the back of the container without worry that the vehicle will collide into the back-situated part 450*b* during a fork-insertion operation or otherwise. Stopper pins 402*i* may be removably inserted into holes 402*h* defined in the pockets for preventing the forks from being inserted too deeply into the pockets 402*a*. The same stopper pins or other such pins may then be used as fork-retaining pins if corresponding retainer holes (432*d*) are provided elsewhere along the lengths of the forks (e.g., 432). Alternatively or additionally, one or more adjustable fork-insertion limiting means such as the clamp shown at 432*c* may be provided on one or both of the forks for limiting the distance by which the forks could be inserted into the pockets 402*a*. The use-instructing means (311*b* of FIG. 3A) may provide instructions for the proper use of these and/or other means for limiting fork insertion depth into the pockets.

Another way of controlling fork insertion depth into the pockets is by use of the fork insertion bumpers (e.g., 432*b*). Some form of rubber-like bumper is often interposed between the lift-arm crossbar (330*b* in FIG. 3A) and a countering, bumper pad on the intermediate container for absorbing the forwards shock of a fork-insertion operation. Typically the bumper pad is simply a flat area of metal just inside of the fork-receiving openings on the pockets. Dashed prism 460*e* indicates such a positioning in FIG. 4A. The difference in FIG. 4A though, is that the bumper pad 460*e* is no longer part of the back wall 402*b* of the intermediate container. Instead the bumper pad 460*e* is disposed rearward by an appropriate distance (e.g., about 10 or more inches) beyond the refuse-containing back wall 402*b*. Any of a variety of means may be used for setting the position of the bumper pad 460*e* rearward of the back wall 402*b*. FIG. 4A shows one example in solid where the bumper pad 460*d* is formed as an integral part of a protective cage 460 such that the bumper pad 460*d* will occupy region 460*e* when the protective cage 460 is fastened (461) to the intermediate container and/or its pockets 402*a*. More on this shortly. Appropriate spacers may be alternatively or additionally placed on the bumper holding parts (not shown) of the vehicle for controlling the spacing between the front of the vehicle (301) and the back wall 402*b* of the intermediate container.

The reinforcements for the backwardly-extended parts of the pockets do not have to be outside the curbside and street-side walls (402*c*, 402*d*) of the intermediate container as shown by reinforcing brackets 402*e* of FIG. 4A. Partial indentations (not shown—see FIG. 4B) may be defined in the container sidewalls (402*d,c*) for receiving a shorter version of the reinforcing brackets 402*e*, with the pockets (402*a*) welded and/or otherwise fastened to the shorter version, while the remainder of each longer pocket is welded or otherwise fastened to a non-indented part of the corresponding container sidewall (402*d,c*). In the latter case, one of ribs 402*g* may be welded to and/or otherwise fastened to the respective container sidewall (402*d,c*) while a more rearward other rib (or gusset or other structural reinforcement) is welded and/or otherwise fastened to the rearwardly extending part of the reinforcement bracket 402*f*. As will be appreciated, the triangular ribs 402*g* may be configured to help carry the weight of the container/robot combination 402/450 on the forks. Thus, although not specifically shown, it is within the contemplation of the disclosure to have one or more triangular and/or otherwise-shaped support reinforcing means disposed rearward of the rear refuse-containing wall 402*b* of the intermediate container for providing re-enforced weight-bearing support to the portions of the fork-receiving pockets which extend rearward of the rear refuse-containing wall 402*b*.

The magnitude of rearward extension of the fork-receiving side pockets 402*a* should be such as to assure that the back-mounted portion 450*b* of the robotic arm mechanism 450 stays in front of an arm clearance plane 432*a* during frontal lift-and-dump-over-the-top operations. In some situations, rather than using solid bumpers against bumper pads such as 460*e*, operators may insert fork-bumper tubes 432*b* (made of a rubbery material) at the rear end of the forks in order to protect the forks and/or main lift arms from being damaged by metal to metal collision with the rearward ends of the pockets. This is not a problem because it merely advances the container/robot combination 402/450 slightly forward (in the +X direction) along the forks. Clamping means 432*c* may be used in operative cooperation with the fork-bumper tubes 432*b* for adjustably defining the spacing created between the front of the waste collections vehicle and the back of the rear-portion 450*b* of the robotic arm mechanism 450.

A variety of different configurations are possible for the internal components of the side-loading robotic arm mechanism 450. FIG. 4A depicts an L-shaped configuration wherein motors 452, 453 and controls 457 constitute a major portion of the mass of the robotic arm mechanism and these are contained in backwall section 450*b*. Motor 451 may be constructed with a relatively small mass (less than that of motor 452 or that of motor 453) because motor 451 merely powers the grasp and ungrasp operations. Accordingly, motor 451 may be situated within the sidewall section 450*c* of the overall robotic arm mechanism 450 even though it would be better to move the mass of this small motor 451 to the backwall section 450*b* as well. If the grasp/ungrasp actuating motor 451 is relocated into backwall section 450*b* (see also FIG. 4D), then various low-mass, energy transferring means may be deployed for transferring the mechanical power of the relocated motor 451 (relocated into section 450*b*) to the waste item grasping part of the arm that still remains in sidewall section 450*c*. Examples of such power transferring means include: (1) a shutter-release style cable mechanism (e.g., a flexible cable slides differentially relative to a surrounding tube to provide grasp and/or ungrasp energy); (2) a bicycle style chain for rotating a gear or like means provided on the grasper (i.e., 351); and a rotating link tube which has a gear or the like at its end for coupling with counter-gears or like means provided on the grasper.

An example of a shutter-release style cable mechanism is shown at 451*c*. An inner cable is reciprocatingly situated within an outer tube. Both the inner cable and the outer tube are flexible at least around their mid-portions. At least the outer tube is rigid around its terminal ends. Reciprocation at a first end of the shutter assembly (451*c*) by the inner cable relative to the outer tube, or vice versa, results in a like, differential reciprocation at the opposed end of the shutter-release style cable mechanism. Thus, motor means 451 (e.g., a hydraulic piston or an electric motor) may be relocated to the backwall section 450*b* while the differential cable assembly (451*c*) flexibly transfers the grasp and/or de-grasp movement power of the motor 451 to a scissor-style grasper 451 or another appropriate grasping mechanism. Such relocation of the motor means moves more of the mass of the overall robotic mechanism 450 rearwardly and thus helps to reduce beam-mass vibrations that may occur further forward of clearance plane 432*a*.

Note that when hydraulic motors are used, it is not only the mass of the hydraulic pistons or other such hydraulic means that contribute to overall mass. There is usually also the mass of the hydraulic fluid and the flexible hoses (e.g., 459) which carry the pressurized fluid and the return fluid. In accordance with one aspect of the disclosure, selective drainage means may be provided for draining or reducing the amount of fluid in the container/-robotic mechanism combination 402/450 when the robotic mechanism 450 is not about to be immediately used; such as when the hauling vehicle (301) is moving faster than a predetermined speed and/or when the front forks are lifted above a predetermined height. Appropriate sensors (not shown) may be installed for detecting one or more of these events, and a responsive air pump may be operatively included to replace the liquid hydraulic fluid with air in the pistons and/or hoses and/or elsewhere so as to selectively reduce the mass of the container/robotic mechanism combination 402/450 during times when use is not imminent. An electromagnetic or other clamping means may be used to clamp movable parts into place when hydraulic power is purposefully removed for the above purpose.

Where practical, like reference numbers in the "400" century series have been used in FIG. 4A to denote alike elements which are referenced by corresponding numbers in the "300" century series in FIG. 3A. Thus element 451 may correspond to items 351 and 351*b* of FIG. 3A as should already be apparent in view of the discussion of assembly 451*c*. Element 452 may correspond to Y-axis extension item 352 of FIG. 3A (and/or 252", 254, 255 of FIG. 2C). Similarly, element 453 may correspond to load-rotating item 353 of FIG. 3A (and/or 253 of one or more of FIGS. 2A-2D). The specific configuration of robotic mechanism 450 can vary. The main point is to move the center of its mass as far rearwards along the −X axis as practical so as to minimize the effective beam length of the equivalent, mass-on-a-cantilevered beam model and to thereby discourage mechanical oscillations from developing, particularly at low frequency and high magnitude.

In relocating the center of mass of the robotic mechanism 450 rearward by situating most of its mass behind the backwall 402*b* (e.g., by mounting most of its mass in backwall section 450*b*), it is desirable to keep the rear-situated portion (450*b*) of robotic mechanism 450 in front of the arm clearance plane 432*a*. It is further desirable to keep the width of the re-configured robotic mechanism 450 inside of the main arm clearance lines 430*f* of the associated lift vehicle (e.g., 301' of FIGS. 3A-3B). FIG. 4A shows that the Y-axis reciprocating part 452 has been mounted sufficiently high and/or forward within the backwall section 450*b* (sufficiently high along back wall 402*b* of the container) so as to assure that the reciprocating action of part 452 (and/or of open digits 451*a*) will clear a predefined, fork piston clearance line 434 when the lift arms are lowered and leveled into a lowest, predefined waste collecting height state.

As is true with the mass of motors such as 451-453, the weights of the hydraulic control valves 457 and other elements (e.g., electrical controls) are also preferably kept back behind the rear wall 402*b* of the intermediate container so as to shift as much of the center of gravity of the combined container 402 and robotic mechanism 450 rearwards (in the −X direction) and to thereby reduce the effective beam length of the beam-mass system. Note that a rearward extending bundle 457*a* from control valves module 457 may have as few as two hydraulic lines, one for providing hydraulic power input (e.g., at about 2000 psi) and one for returning low pressure hydraulic fluid back to the hydraulic power drive on the vehicle. A larger number of hydraulic hoses may emanate from the control valves module 457 to the multiple hydraulic motor means of the robotic arm mechanism 450. As few as two hydraulic quick-disconnect couplers may therefore be provided at the rearward end of hose/cable bundle 457*a* for providing quick attachment or detachment to/from the transport vehicle. Bundle 457*a* may also include electrical control and/or power wires for carrying electrical control and/or power signals between the transport vehicle and the robotic arm mechanism 450. The control signals may include sensor signals from sensors on the robotic arm mechanism or elsewhere about the intermediate container. The control signals may include command signals for actuating hydraulic valves and/or otherwise actuating motorized parts of the robotic arm mechanism and optionally other motorized features of the intermediate container. One or more quick-disconnect electrical couplers may be provided at the rearward end of hose/cable bundle 457*a* for providing quick attachment or detachment to/from electrical nodes of the transport vehicle. It is within the contemplation of the present disclosure to use wireless transmission (e.g., RF or optical) of various control or sense signals. Battery means may be provided within the intermediate container and/or robotic arm mechanism for supplying electrical power to the robotic arm mechanism or other components adjacent to the intermediate container. Care should be taken that the power/control hose/cable bundle 457*a* does not get tangled with other objects (e.g., the next-described, protective cage 460) during lift and/or dump-over-the-top operations since the bundle often has to flexibly extend in some manner or another between the vehicle body and the robotic arm mechanism. In one embodiment, the vehicle-sides of the quick disconnect couplings are tied down to the lift arms so as to move with the lift arms.

In order to protect sensitive parts of the backwall robotic section 450*b* from short-dump collisions, a protective cage 460 may be optionally welded (461) or otherwise fastened to the intermediate container 402, for example to the inside walls of the backwardly-extended fork pockets 402*a*. Crossbar section 460*a* should be configured to rest directly or indirectly (e.g., through a bumper pad) against the crossbar (330*b*, FIGS. 3A-3B) of the main lift mechanism. Vertical bar section 460*b* may be optionally included and configured in roll bar fashion to protect collision sensitive parts such as valves 457 from short dumps. A forward bending part 460*c* of the roll bar 460 may be spot welded (462) to the backwall 402*b* of the container for further reinforcement. One or more bumper-engaging pads such as 460*d* (and/or elastomeric bumpers themselves) may be integrally provided on the protective cage if desired. The integrated bumpers and/or bumper-engaging pads 460*d* may be positioned to appropriately limit how close the vehicle front gets to the container backwall 402*b* as was already discussed above.

In making various additions and modifications to the illustrated configuration of FIG. 4A, it should be recalled that one of the intents here is to reduce the mass of the container/robotic mechanism combination 402/450. Thus the use of a too-elaborate and massive of a protective cage 460 or addition of too many massive components to other parts of the fork-liftable combination of the intermediate container 402 and robotic arm mechanism 450 can be counterproductive. Although a wide variety of protective means may be fashioned about the rear side of robotic back portion 450*b*, caution should be used.

As already indicated, the L-shaped configuration of robotic mechanism portions 450*b* (back portion) and 450*c* (curbside portion) is but one of many possible arrangements. The extent of the robotic mechanism may be increased to a U-shape which wraps itself to the front of the container as well as along the curbside (402*c*) and the backside (402*b*). The front portion (not yet shown) may include a selectively retractable one or more wheels and/or a second robotic arm which extends out to the left (streetside) but is driven by motors (e.g., hydraulic motors) situated in the rear-mounted portion 450*b*, where the rear-mounted motors couple to the driven front portion with low-mass coupling means of the type described above. The important aspects to remember is that the waste-item grasping means such as 451*a* and their associated drivers (e.g., 451*c*) should be retractable so as to become contained within the boundaries of arm clearance lines 430*f* and forward of arm clearance plane 432*a*.

Figure 4B:
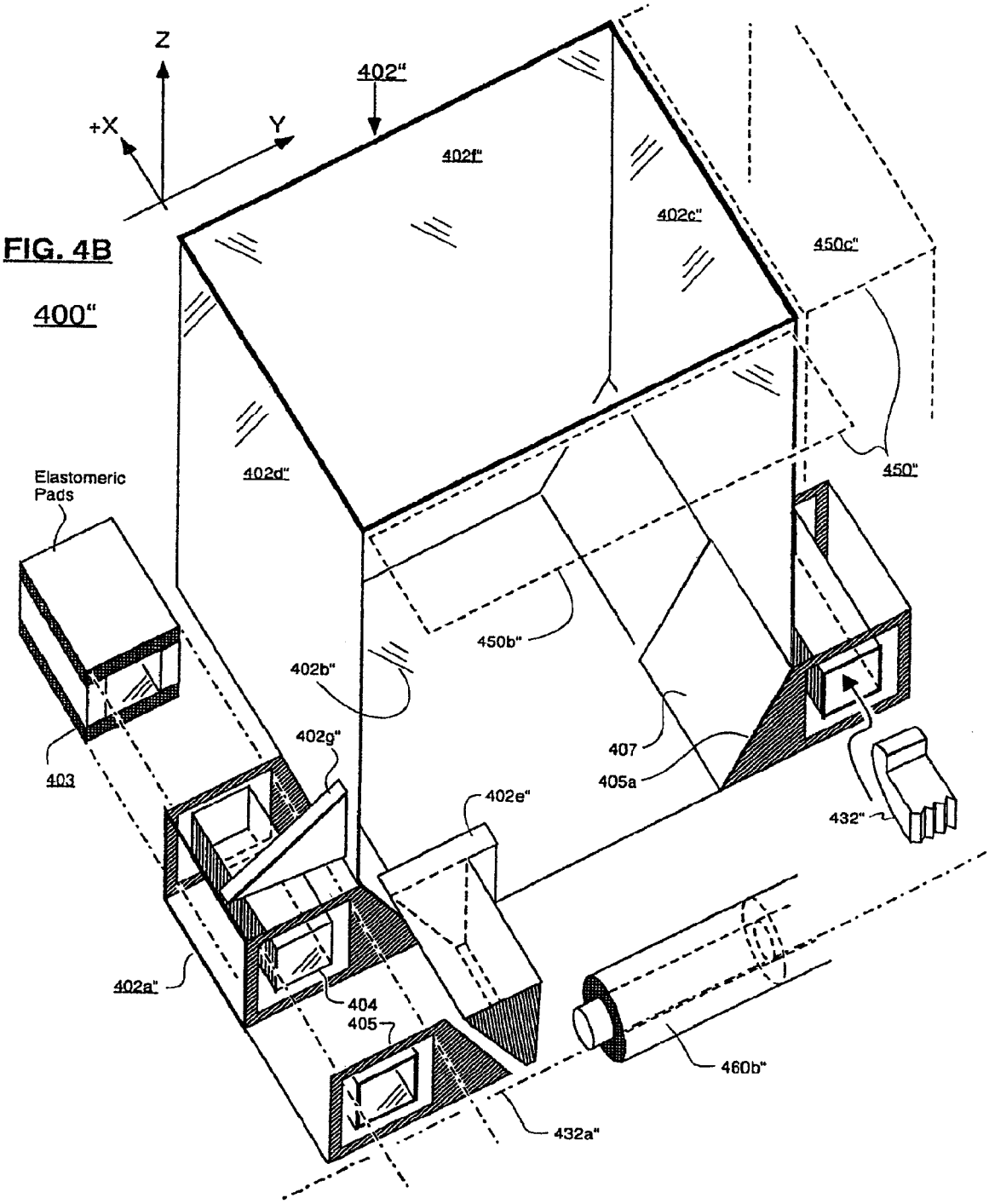
FIG. 4B is a perspective view with exposed cross sections for showing how a vibrations dampening subsystem may be integrated into a refuse-collections container that includes rearward extended pocket means.

FIG. 4B shows in perspective, a further possible arrangement 400" for coupling a combination of an intermediate container 402" and a side-loading robotic arm mechanism 450*b*"/450*c*" to the forks 432" (only one shown) of a front-loading vehicle. Where practical, like but double-primed (") reference numbers in the "400" century series have been used in FIG. 4B to denote alike elements which are referenced by corresponding numbers in FIG. 4A. Thus, a detailed reiteration is unnecessary. Pockets 402*a*" differ over those of FIG. 4A at least because they are now structured to have a metal inner sleeve 404 (e.g., stainless steel) that is elastically supported within an outer pocket member 405. Elastomeric pads 403 are interposed between each inner sleeve 404 and outer pocket member 405 for absorbing at least some of the mechanical vibrations passing from fork 432" to the container/-robotic arm mechanism 402"/450" or vice versa and for converting the absorbed mechanical vibrations into thermal energy. In one embodiment, the elastomeric pads 403 include Neoprene™. Additional and/or other elastomeric materials may be used for dampening corresponding ones of X-axis, Y-axis, Z-axis and/or torsional vibrations as may be appropriate for the specifics of a given container configuration. Viscoelastic fluids may also be included in the vibration dampening subsystem (403). The damped arrangement 400" has the advantage of not only the shortened cantilevered beam length with the center of mass closer to the cantilever point, but also of being further damped to reduce oscillations. This in-pocket dampening (403) can be used in place of or in combination with the cradle-based dampening (314) shown in FIG. 3B. The in-pocket dampening means (403) may be configured to be removably inserted within the outer pocket structure 402*a*" so that it can be replaced with different dampeners of differing vibration absorption properties and/or with a non-dampening filler tube (not shown).

As seen, the inner sleeve 404 is dimensioned so that the lift fork 432" can be easily inserted and/or removed from the damping pocket 402*a*" by conventional means. Holes may be provided through the dampener for passing through, fork-retaining pins. In one embodiment, at least two retaining pins are used per pocket. One retaining pin couples the fork to a forward or rearwardly protruding part of the elastomerically-suspended inner sleeve 404. The at least second retaining pin couples the elastomeric padding 403 to the outer pocket 405. Numerous retaining-pin holes may be provided so that positioning along the fork and distance between where the fork couples to the elastomeric padding 403 and where the elastomeric padding couples to the outer pocket 405 can be varied by repositioning the retaining pins.

Each outer pocket member 405 may include an angled portion 405*a* that aligns with a similarly angled chamfer 407 in the bottom curbside and streetside edges of the container 402". A similarly angled surface may be provided on each of the reinforcement extension members 402*e*" (only one shown) of the container. The angled outer surface 405*a* of each outer pocket member 405 may be welded, bolted, and/or otherwise fastened to the correspondingly angled walls of the main container and of the re-enforcement extension members 402*e*". The inside-located ends of the reinforcement extension members 402*e*" (the ends near the crossbar) may also function as bumper pads. Although a fork-based embodiment 400" has been detailed in FIG. 4B, it is within the contemplation of the disclosure that elastomeric damping means may be integrally incorporated into embodiments which allow for other retractably engageable lift means. For example, if the A-frame approach is implemented, the elastomeric damping means may be integrally incorporated as a triangularly shaped Neoprene collar (not shown) inside the triangularly shaped indent of the container wall. The utilized damping means does not have to be restricted to elastomeric materials. Air bellows or other damper designs may be used.

In FIG. 4B, the optional protective cage (see 460 of FIG. 4A) may include a cross member 460*b*" which extends between the re-enforcement extension members 402*e*" and which is covered with an elastomeric bumper pad material for absorbing impacts with the lift crossbar and/or other items. Further bumper pads may be provided on the vertical or other such bars (not shown) of the protective cage. Although FIG. 4B shows only one reinforcing rib 402*g*" connecting to the curbside wall 420*d*" and the top of the outer pocket member 405, it is to be understood that further such re-enforcing ribs (or other gussets) may be provided along the container side walls 402*d*, 402*c* and also extending from the reinforcement extension members 402*e*" to the top of the outer pocket members 405 for providing added support. The reinforcement extension members 402*e*" may be welded, bolted and/or otherwise fastened to the main body of the container 402".

Figure 4C:
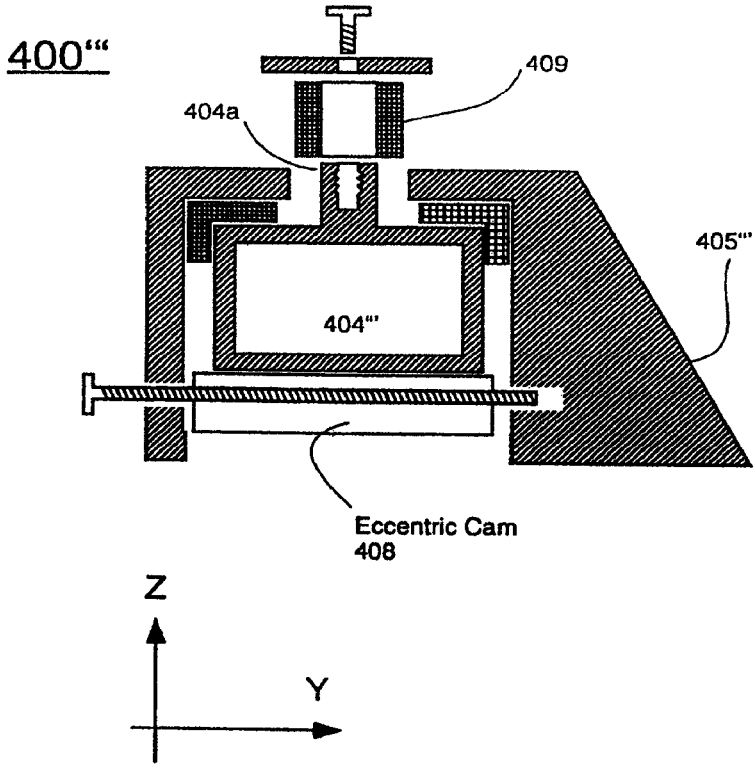
FIG. 4C is a cross sectional view of an embodiment of the vibrations dampening subsystem of FIG. 4B.

FIG. 4C shows a cross sectional view of one embodiment 400'" in which each inner sleeve 404'" includes vertical projections 404*a* for fail safe interlock with the outer pocket member 405'". If the elastomeric dampening pad or pads break down, projections 404*a* may nonetheless remain locked into corresponding openings in the outer pocket member 405'". Fastening of the elastomeric material to the outer pocket member 405'" and/or pretensioning of upper elastomeric washer 409 may be controlled (at least partially) by the tightening of the illustrated upper screw (above 409). Fastening of the elastomeric material to the outer pocket member 405'" and/or pretensioning of the lower elastomeric pad may be controlled (at least partially) by the tightening of the illustrated lower locking screw and rotation of one or more eccentric cams 408 that lock into position when the lower locking screw(s) is/are tightened. In the illustrated embodiment 400'", different elastomeric materials may be used for controlling Z-direction vibrations and X-Y plane vibrations. For example, cylindrical dampener 409 may be structured to absorb the shock of mechanical motion in the X-Y plane, but not in the Z-plane when the intermediate container is level to the ground.

Figure 4D:
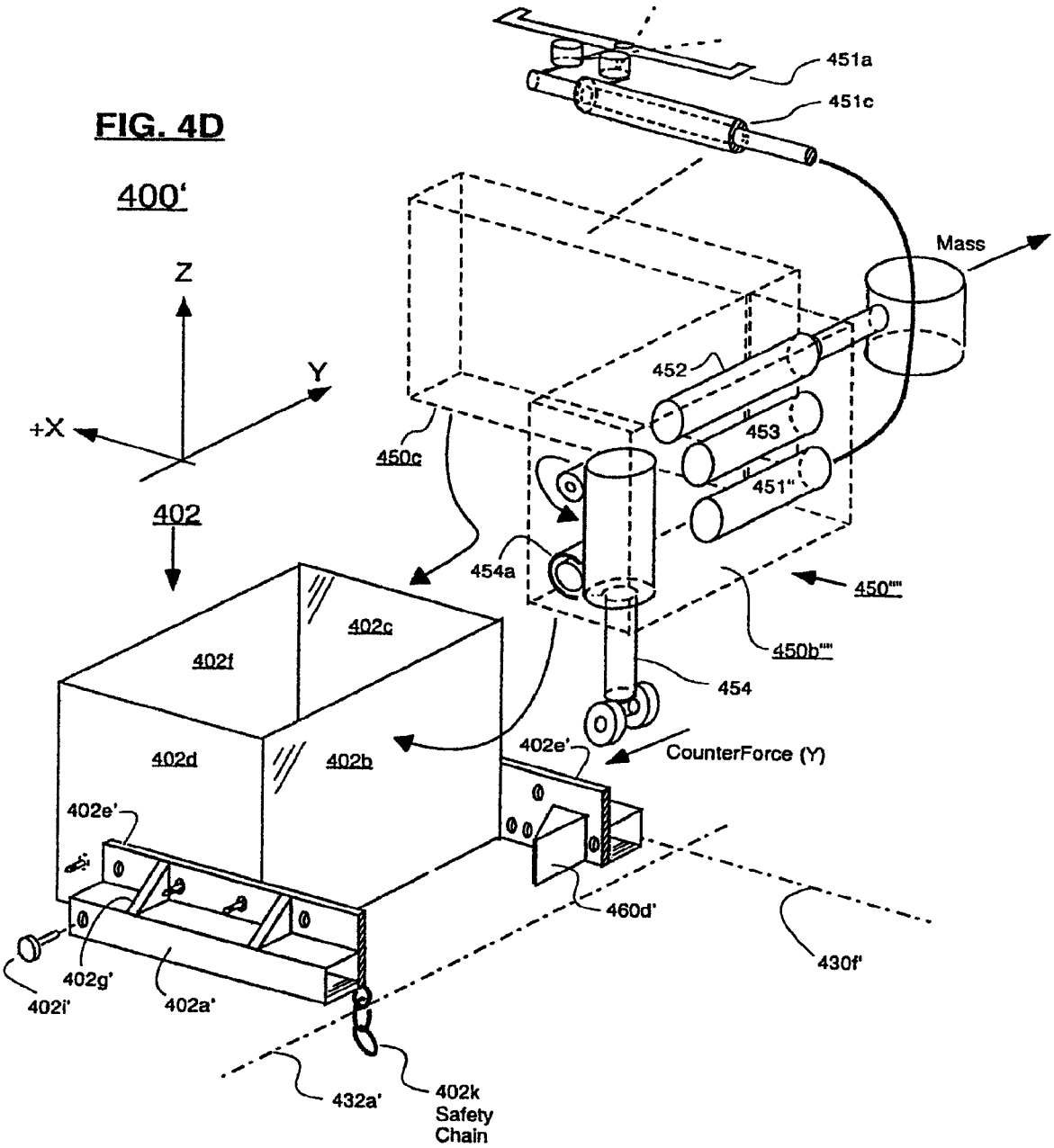
FIG. 4D is a schematic and exploded perspective view showing how a retractably extendible leg means can be used to counter the inertial forces of a robotic arm mechanism, where use of the robotic arm mechanism can cause a load mass to move rapidly at least in a sideways direction.

FIG. 4D shows the optional addition of a motorized retractable leg 454 to the back-mounted robotic mechanism 450'". When the mass at the end of Y-reciprocating actuator 452'" moves to the curbside or back, a counterforce is exerted by the opposed end of actuator 452" against the intermediate container 402'". Elastomeric dampeners may be used to absorb part of this counterforce. Additionally or alternatively, before actuator 452" is activated to move its load mass at high velocity, a retractable leg with a partially-pivoting bottom wheel may be brought down by motor control to make touching contact with the underlying pavement. Sensors in the partially-pivoting bottom wheel or elsewhere can be used to detect when sufficient pressure exists between the lowered peg leg 454 and the pavement for providing a counterforce in the Y-direction to counter the inertia of the Y-axis actuator 452", and at that point, the motor-controlled lowering of the peg leg 454 is halted. The partially-pivoting bottom wheel(s) at the bottom of the peg leg should not be allowed to pivot into alignment with the Y-axis because that would eliminate the desired counterforce between the pavement and the peg leg 454 in the Y-direction. On the other hand, because the front-loading vehicle may continue to roll forward or steer around obstacles as trash is being collected, pivotable rolling of the peg leg 454 at least in the X-direction is desirable. A break-away shear pin 454*a* of the type used for outboard boat motors can be used to let the peg leg 454 safely pivot away from encounter with a pothole or another such obstruction. The break-away shear pin 454*a* may have a predefined torquing threshold at which it gives way.

Although just one peg leg 454 is shown in FIG. 4D, it is possible to have 2 or more such automatically lowered and retractable legs. If two or more are used, a streetside leg may be lowered first, just before the Y-direction actuator 452" pushes out its load mass in the curbside direction. A curbside, second leg is lowered into contact with the pavement just before the Y-direction actuator 452" pulls its load mass (with or without a waste-item included as part of the load mass) back towards the streetside direction. Both legs are automatically retracted into the underbelly of robotic mechanism portion 450B"' just after the grasper and Y-reciprocator of robotic mechanism 450"' retract. The latter typically happens after a waste basket has been returned to the curbside and the driver is ready to drive the vehicle forward for picking up a next waste item. (Incidentally, in FIG. 4D, item 460*d*' is a bumper pad protruding inwardly from a rearwardly extended pocket reinforcer 402*e*'. Item 402*k* is a safety chain which may be used for securing the pocket reinforcer 402*e*' and/or pocket 402*a*' to the crossbar of a supplied transport vehicle (not shown)).

Figure 5A:
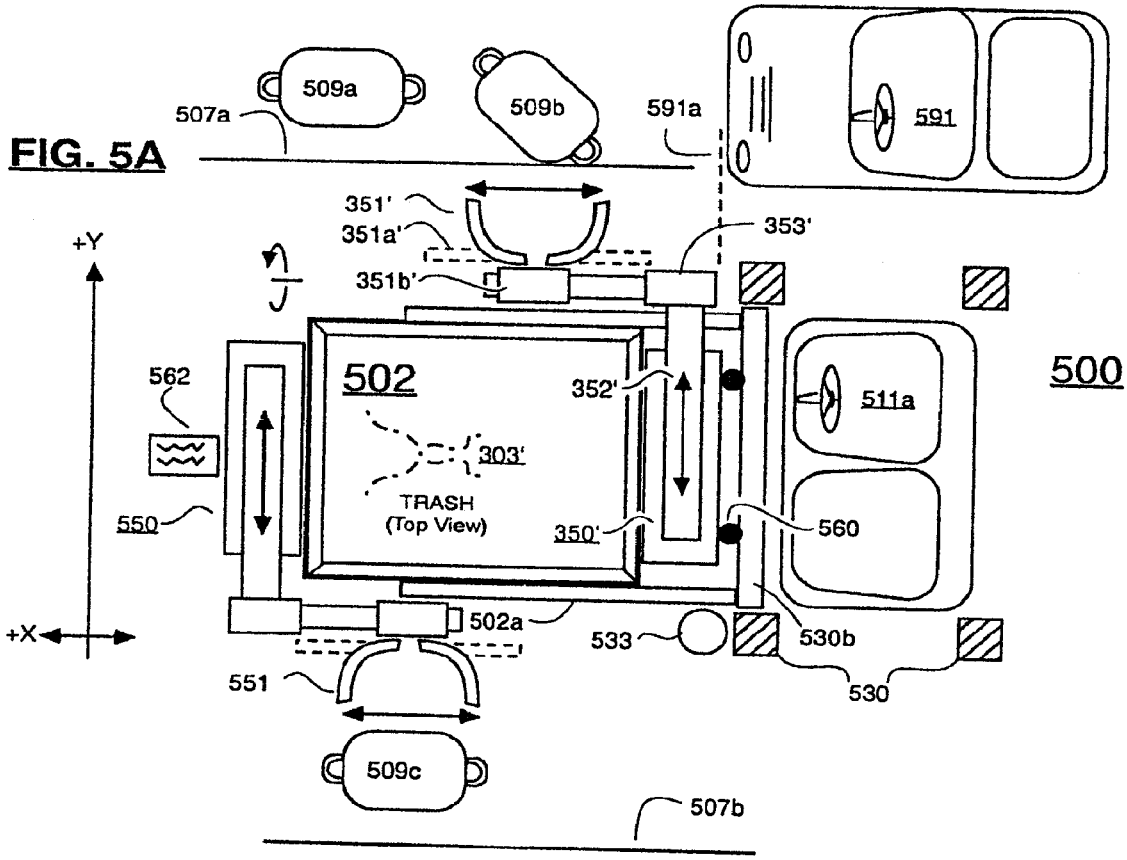
FIG. 5A is a top schematic view showing the operation of a set of side-loading robotic arms whose motor(s) mass is mounted primarily at the back of an intermediate container in accordance with the present disclosure.
Figure 5B:
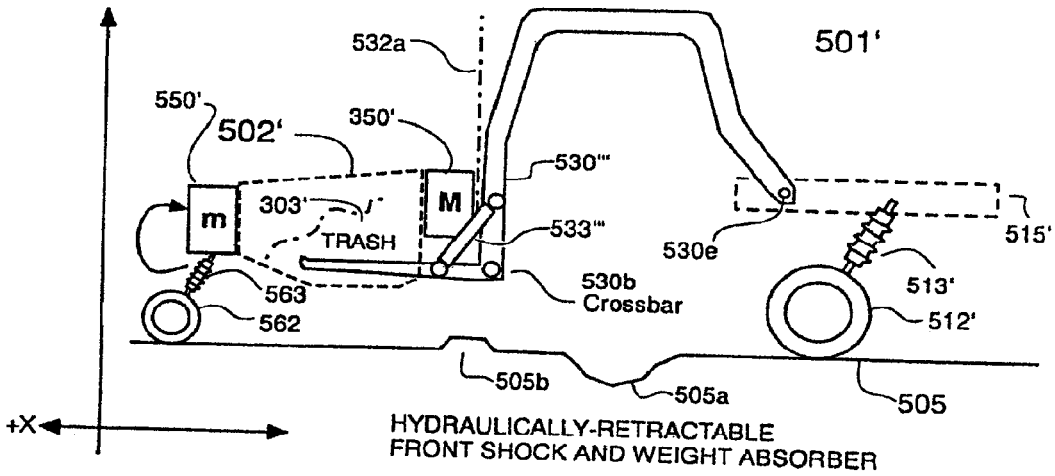
FIG. 5B is a side schematic view showing the operation of the plural side-loading robotic arms whose motor mass is mounted primarily at the back of a front-loaded bin in accordance with the present disclosure.

FIGS. 5A-5B respectively show top and side schematic views of another embodiment 500. Where practical like reference numbers in the "500" century series are used for elements of FIGS. 5A-5B that have counterpart elements in the "300" century series in FIGS. 3A-3B. It may be readily seen that there are two robotic arms 351' and 551 in FIG. 5A. The back-mounted arm may be essentially the same as in the previous figures and may have most or all of its motor mass mounted in rear portion 350'. The front-mounted arm 551 is arranged to pick up waste items (e.g., 509*c*) disposed on the opposed, left side of the intermediate container at the same time that arm 351' picks up waste items (e.g., 509*b*) disposed on the right side. The front-mounted arm mechanism 550 is not a full mirror image of the back-mounted portion 350'. Instead, a substantial portion of the motor mass and controls mass for the front-mounted arm 550 resides in the back-mounted portion 350'. Low-mass, power transferring means are deployed for transferring mechanical power from the rear-mounted motors in section 350' to smaller mass portion (m) in the front section 550. Examples of such low-mass power transferring means include the shutter-release style cable mechanism described above. Thus, although it may appear that front section 550 is the same as the front-mounted robotic arm mechanism 250 of FIGS. 2A-2B; it is not.

A reason for having left and right side extendible arms 551 and 351' (respectively) is to support alley-based pick up. In some residential situations, waste items are lined-up on left and right sides of a narrow alley way, 507*a*-507*b*. Two waste vehicles cannot fit side by side in such a narrow alley way. Instead, in the past, a one-sided side-loading truck had to drive down the alley in a first direction for picking up right-side situated trash (509*a*, 509*b*). Then the vehicle had to turn around and rive down the alley way, 507*a*-507*b* in the opposed direction to pick up left-side situated trash (509*c*). The embodiment 500 of FIGS. 5A-5B obviates the need for driving down the alley in both directions and it therefore can substantially reduce pick up time. Additionally residents of the tight alley or other roadway are subjected to trash pickup noise and/or truck emissions for a shorter length of time.

In one variation, a motor-retractable front wheel mechanism 562-563 is provided in the front section 550'. Shock absorber 563 helps to absorb some of the mechanical vibrations that may otherwise transfer back to the main lift arms 530'" of the vehicle 501' during a collections run. Alternatively or additionally, dampeners may be included in the side pockets 502*a* of the container for absorbing some of the mechanical vibrations. Alternatively or additionally, cradles may be included on the front of the vehicle (see 314 of FIG. 3B). If the optional front wheel 562 is provided and used, the vehicle operator may lower and raise the motor-retractable front wheel 562 as the operator deems appropriate for a given situation. Therefore, if there is tight steering environment, the motor-retractable front wheel 562 may be easily taken out of the way. There are situations where it may be appropriate to use plural robotic arm mechanisms of differing weights and power capabilities, where one mechanism (the heavier one) can pick up relatively heavy waste but consumes more power in doing so and where the other mechanism (the lighter one) can pick up only relatively light weight and/or small-sized waste but consumes less power in doing so. In such cases, and in accordance with the present disclosure, the heavier robotic arm mechanism (or at least the motor mass for the same) is mounted to the rear of the intermediate container while the lighter robotic arm mechanism is mounted more forward.

Figure 6:
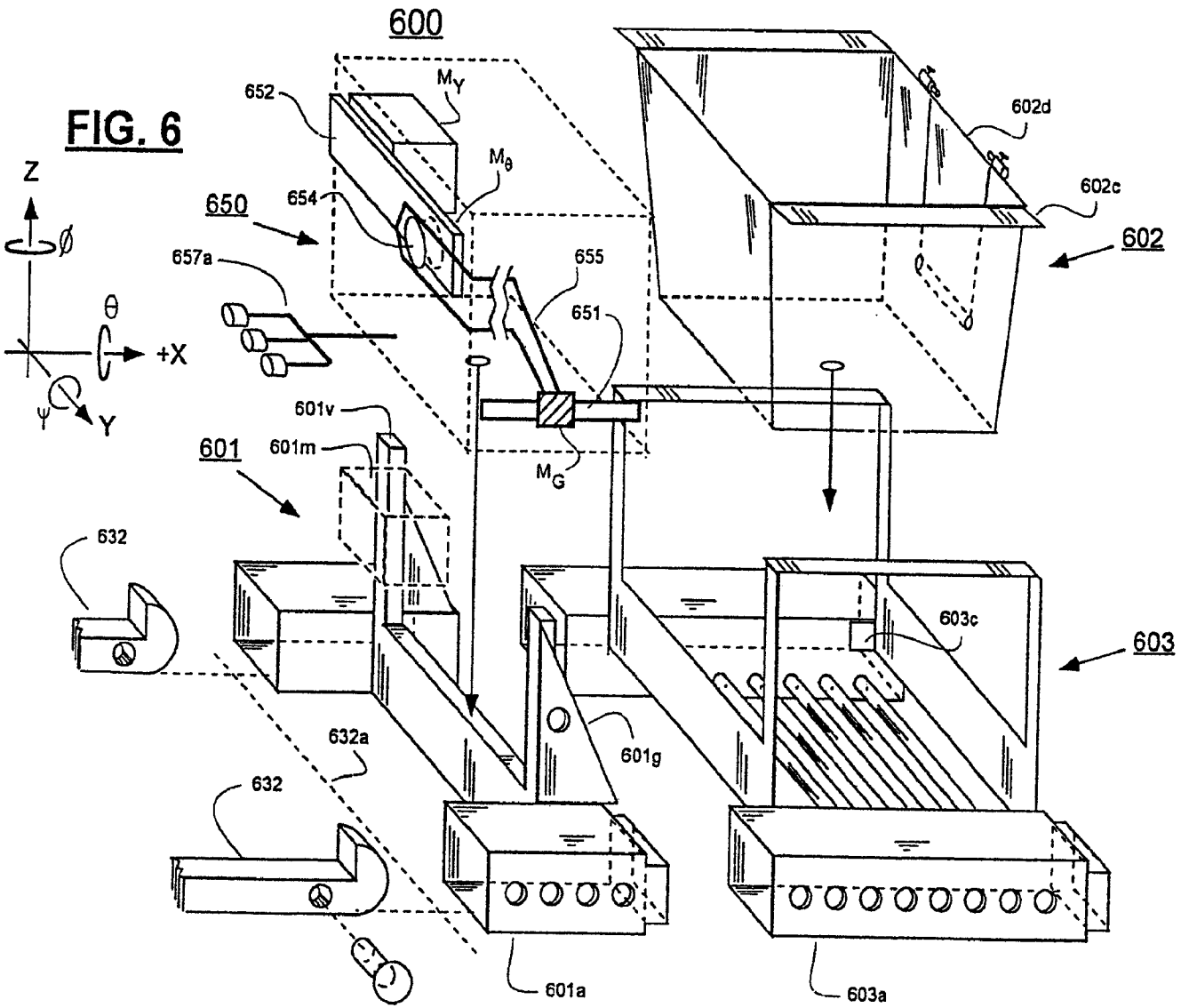
FIG. 6 is a perspective schematic view showing a first modular combination of an intermediate container, a robotic arm mechanism and a modular supporting sled.

FIG. 6 is a perspective schematic view of a so-called, modular sled embodiment 600. The illustrated items are not necessarily to scale. Where practical like reference numbers in the "600" century series are used for elements of FIG. 6 that have counterpart elements in the "300" or "400" century series in FIGS. 3A-3B, 4A-4D. The supporting sled of the illustrated embodiment is formed of modularly combinable, first and second sled frame sections 601 and 603. (In another embodiment, sled frame sections 601 and 603 may be integrally combined to define a uni-body sled.) As should be apparent from FIG. 6, the major mass portion 650 of a rear-positioned robotic arm mechanism is mounted to the first sled frame section 601. Portion 650 may be fixedly or detachably coupled to the supporting first sled frame section 601. In one embodiment, motor $M_y$ attaches to vertical stanchion 601*v* at for example, dashed position 601*m* so that the Y reciprocating member 652 situates rearward of the stanchions. When in region 601*m*, the stationary part of motor $M_y$ may be fastened not only to stanchion 601*v*, but additionally or alternatively to cross-brace 601*g* and/or other parts of the first sled frame section 601 so as to provide appropriate structural support for the weights borne by reciprocating member 652 and so as to absorb back-stresses being transmitted back to the first sled frame section 601 as the robotic arm mechanism carries out its various operations. Various further couplings may be used for attaching the components of rear mass portion 650 of the robotic arm mechanism to the first sled frame section 601. Such couplings may include elastomeric and/or other shock absorbing means for absorbing mechanical back-vibrations from the operating robotic arm. It is to be understood that grasper 651 situates forward in the Y direction of brace 601*g* so that grasper 651 may freely translate out in the Y direction to grasp external waste.

A removably fastenable, container 602 is inserted into the second sled frame section 603. (The removably fastenable, container 602 may be slid into receiving slide indents (not shown) and/or removably bolted into place on the sled.) The major mass portion 650 and first sled frame section 601 of the illustrated embodiment are interposed during use between (a) the container 602 and/or the second sled frame section 603, and (b) one or more of electrical and hydraulic sources (657*a*) that provide control and/or power to the robotic arm mechanism (650). The left and right pocket sections 601*a* of the first sled frame section 601 can modularly combine with the respective left and right pocket sections 603*a* of the second sled frame section 603 to form respective left and right pockets, where the latter receive, and ride on, the respectively illustrated left and right forks 632. Although all details are not shown in FIG. 6, all of the above described options concerning situating the rear positioned portion 650 of the robotic arm mechanism ahead of clearance line 632*a* may be optionally applied alone or in various combinations as may be suitable for particular, waste-collection environments. All of the above described options including those concerning use of cradles (314 of FIG. 3B), in-pocket dampeners (FIG. 4B), protective cages (FIG. 4A), counterforce peg legs (FIG. 4D) may be optionally applied alone or in various combinations as may be suitable for particular, waste-collection environments.

A motivation for the modular, multi-section configuration of the sled embodiment 600 shown in FIG. 6 is that waste-collection environments change, just as was implied at the very beginning of this disclosure. Sometimes, a waste collection organization wants to use only a front-loading vehicle (e.g., 101 of FIG. 1A) by itself, without having an intermediate container detachably added to the front of the vehicle. Sometimes the waste collection organization may choose to use an A-frame style, retractable lift mechanism rather than a fork-based one. (See briefly FIG. 7.) Sometimes the waste collection organization may find it prudent to use only the intermediate container (602/603) and the front-loading vehicle (632) without having a robotic arm mechanism (650/601) interposed between the vehicle and intermediate container. Sometimes the waste collection organization may find it prudent to use the intermediate container (602/603) with two sets of robotic arms (e.g., as shown in FIG. 5A with one being extendable to the streetside and the other being extendable to the curbside), where at least one if not both of the plural robotic arm mechanism is interposed between the vehicle and intermediate container.

Moreover, sometimes the waste collection environment is such that very heavy refuse is being collected (e.g., rain-soaked paper products) and it is therefore desirable to use a robotic arm mechanism with comparable, high-power motor means ($M_y$, $M_\theta$, and/or $M_G$) rather than energy-saving low-power motors. Sometimes the waste collection environment is such that very abrasive refuse is being collected (e.g., metal automobile parts from a wrecking yard) and it is therefore desirable to use an intermediate container 602 made of a material (e.g., a metal alloy such as steel) that can survive the impact of such abrasive refuse being dumped into it. On the other hand, sometimes the waste collection environment is such that relatively lightweight and nonabrasive refuse is being collected (e.g., dry office paper) and it is therefore desirable to use an intermediate container 602 made of a material (e.g., a durable plastic) which is lighter in weight than a comparable metal container. Use of the lighter in weight, intermediate container 602 instead of a heavier, interchangeable intermediate container (also 602) can save on energy consumption and reduce the magnitude of stresses imposed on the forks or other detachably-engageable lifting means. (A supplemental or alternate detachably-engageable lifting means will be described shortly in conjunction with FIG. 7.)

In view of the foregoing, the second sled frame section 603 may be structured to detachably receive and secure containers (602) made of different materials of differing densities, differing hardness and/or flexibility and/or durability, including different metals (e.g., aluminum alloys versus steel) and/or plastics (e.g., Neoprene). Various means may be used to detachably secure the modularly replaceable containers (602) to the second sled frame section 603 so that the container does not separate from the latter frame section 603 when a dump-over-the-top operation is performed (see state 102" of FIG. 1A). In one embodiment, screw-operated clamps (not shown) are used to secure rim portions 602*c* of the illustrated, modularly-replaceable container 602 to the second sled frame section 603. Retaining pins, safety chains or other alternatives may be alternatively or additionally used. The illustrated container 602 has a trapezoidal cross section for ease of fitting it into the second sled frame section 603 and/or for encouraging waste to slide out smoothly during a dump-over-the-top operation. A front door 602*d* may be optionally provided in the front side wall of the container 602. The door 602*d* may include a transparent and/or an opaque material. In one embodiment, the front door 602*d* is latched-at-the-top and hinged at a bottom edge of the door. When the door is opened, it can define an inclined ramp leading from the ground to the interior of the container 602. A dolly or other wheeled or sliding means may be used to move heavy items (e.g., refrigerators) along the door-defined ramp, into or out of the container 602. Note that the robotic arm mechanism 650 will be positioned rearward of the intermediate container 602 so that it does not block the use of the front door 602*d* under these conditions.

The first and second sled frame sections, 601 and 603, may each be made of a variety of materials including metals of differing densities and hardness such as aluminum and/or steel. Supporting crossbars such as shown at the bottom of the second sled frame section 603 may be used for keeping the outer pocket tubes, 601*a* and 603*a* spaced apart at a standardized distance so that the first and second sled frame sections will alignably link together. The crossbars can also provide strength for supporting the weight of the container 602 and its contained trash (not shown). Additional weldings such as shown at 603*c* may be made between the pocket tubes 601*a*, 603*a* and corresponding other parts of their respective sled frame sections for strength and stability. Gussets such as the triangularly shaped brace shown at 601*g* may be used for additional strength. The illustrated gusset 601*g* may be used to lock the first and second sled frame sections, 601 and 603, together and it may be used for also locking the modularly insertable, robotic arm mechanism 650 into place. Additionally, triangular gusset 601*g* provides reinforcement during a fork insertion operation when the weight of the modular assembly bears down on the first sled frame section 601 as tilted forks (632) are first inserted while the assembly lies flat on the ground.

Parts of the robotic arm mechanism 650 may be made of lightweight aluminum or heavier steel as appropriate for the loads to be moved by the mechanism 650. Motor $M_Y$ may provide the motive power for translating reciprocating bracket 652 in the Y direction. Motor $M_\theta$ may provide the motive power for rotating the grasper forearm 655 about pivot point 654, in other words for pivoting about a line parallel to the X axis. Pivot point 654 rides on Y-reciprocating bracket 652. Motor $M_G$ may provide the motive power for causing grasper 651 to open and close as appropriate. Additional motor means may be provided for adding more degrees of motion and flexibility to the robot arm 652-655-651. (See FIG. 7.) It is to be understood that the grasper forearm 655 is illustrated in a fore-shortened fashion so to allow visibility of parts positioned forward of it (forward in the +X direction). Typically the forearm 655 will extend a greater distance in the +X direction so as to position the center of grasper 651 near the center of the curbside sidewall of container 602.

Figure 7:
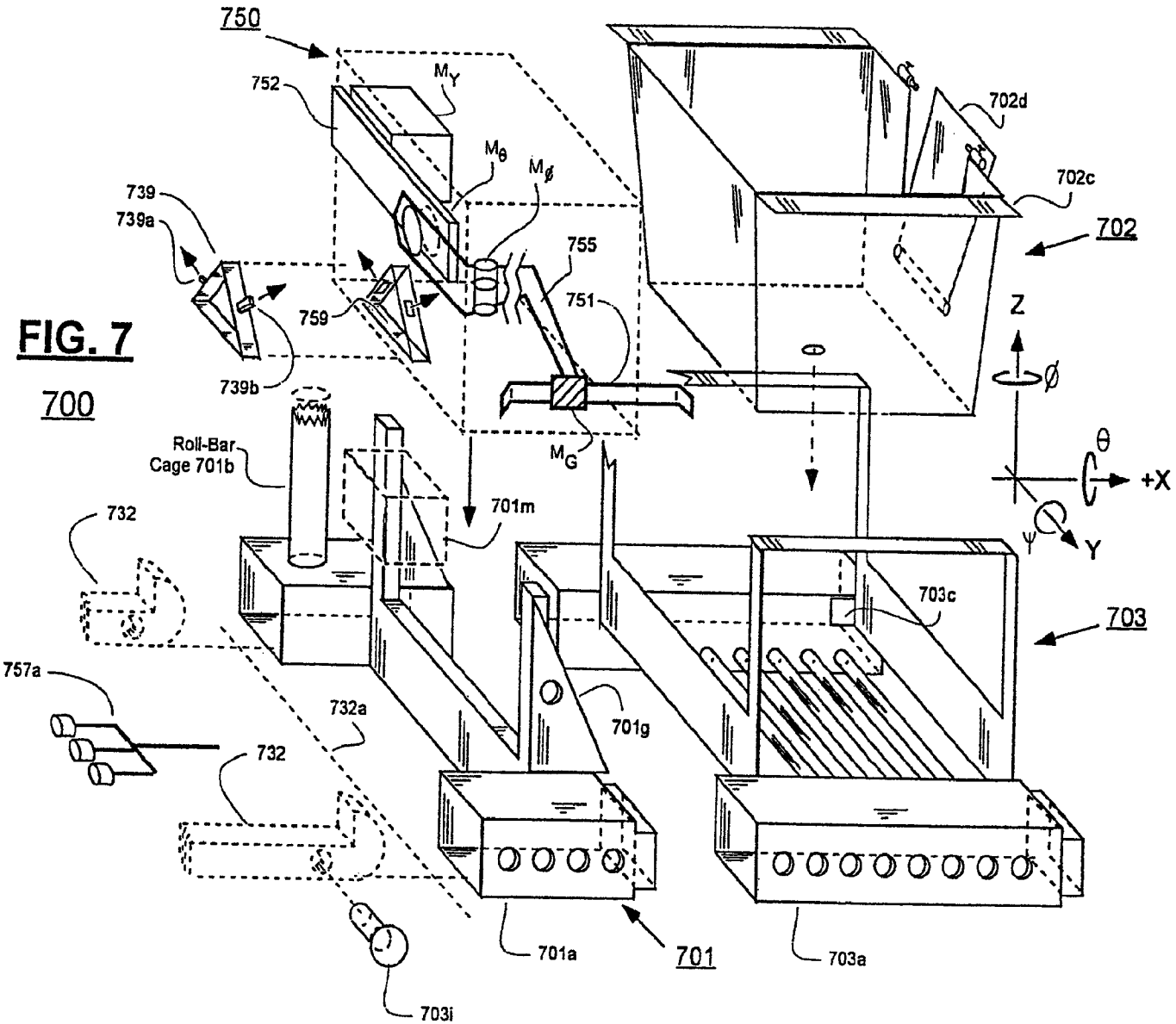
FIG. 7 is a perspective schematic view showing a second modular combination of an intermediate container, a robotic arm mechanism and a modular supporting sled.

FIG. 7 is a perspective schematic view of a second, modular sled embodiment 700. The illustrated items are not necessarily to scale. Where practical like reference numbers in the "700" century series are used for elements of FIG. 7 that have counterpart elements in the "300" or "400" century series in FIGS. 3A-3B, 4A-4D. The supporting sled of the illustrated embodiment may be formed of modularly combinable, first and second sled frame sections 701 and 703, or alternatively, sled frame sections 701 and 703 may be integrally combined to define a uni-body sled. As should be apparent from FIG. 7, the major mass portion 750 of a rear-positioned robotic arm mechanism may be fixedly or removably mounted to the more rearward (−X direction), sled frame section 701. In one embodiment, motor $M_y$ is attached at position 701*m* with bracings provided as explained for 601*m* of FIG. 6. A removably fastenable, container 702 is inserted into the more forward, second sled frame section 703. The major mass portion 750 of the robotic arm and the first sled frame section 701 are therefore interposed between (a) the forward container 702 and/or the forward sled frame section 703, and (b) one or more of electrical and hydraulic sources (757*a*) that provide control and/or power to the robotic arm mechanism (750).

One difference between FIGS. 6 and 7 is that the latter one shows an A-frame receiving pocket 759 being included in bottom part of the robotic arm mechanism 750, where the latter mechanism 750 can be removably or fixedly attachable to the rearward sled section 701. The illustrated A-frame receiving pocket 759 is generally triangularly shaped and has slots at least in two of its apex-forming, inner surfaces. It has a substantially solid front wall which also serves as a rear wall portion of robotic arm mechanism 750. A counterpart, mating head unit is shown at 739. The mating head unit 739 may be mounted between the lift arms 130 of a collections vehicle such as the one 101 shown in FIG. 1A. Such a mating head 739 may be used in place of, or as a supplement to, the lifting forks shown at 132. The illustrated mating head 739 has at least two protrusions, 739*a* and 739*b* projecting either permanently or retractably from the outer two surfaces that join to form the apex of the mating head 739. The mating head 739 also has a substantially solid front wall which can come to bear against the counterpart front wall of pocket 739. Those skilled in the art may appreciate that head 739 does not have to be exactly the same shape and size as the receiving pocket 759. The head may be smaller and may have a rounded apex at its top. The receiving pocket 759 may also have a rounded apex. The more important aspects in the design of the receiving pocket 759 and counterpart head 739 is that the head may be alignably introduced into the receiving pocket 759 so that protrusions 739*a*-739*b* can be reliably aligned to, and locked into, their counterpart slots in pocket 759, and that the head and pocket are made sufficiently strong to bear against one another and reliably lift and hold the weight of the combination of sled portions 701-703, of robotic arm mechanism 750, of modularly replaceable container 702, and of any suitable waste that may be held in container 702. In the case where protrusions 739*a* and 739*b* are retractable, the cab (111) may include controls for causing the protrusions to extend outwardly from head 739 or retract inwardly. The power source for the extraction and retraction may be hydraulic, electrical, or other.

The left and right, fork-receiving pocket sections 701*a* of the first sled frame section 701 are optional. Instead of being positioned only on the robotic arm mechanism 750, the A-frame receiving pocket 759 may alternatively or redundantly be positioned in the first sled frame section 701. A protective roll-bar cage 701*b* (only partially shown) may be integrally extended from the side pockets 701*a* to protectively cover various parts of the robotic arm mechanism 750 as may be appropriate. Of course, openings have to be provided within the protective cage (701*b*, only partially shown) for allowing head 739 to conveniently engage and disengage with non-fork pocket 759. The openings of the protective cage (701*b*) also need to allow slide 752 of the robotic arm mechanism to reciprocate in the Y direction and to allow the forearm 755 and grasper 751 to translate as appropriate for reaching out to grasp external waste and to mechanically bring the grasped waste back for deposit in container 702. If optional forks 732 are used, these may have pin receiving holes for receiving a retaining pin 703*i* which is furthermore inserted frontwards of, or through a hole provided in one of the fork-receiving pockets 710*a*, 703*a* of the assembled sled 701-703. If a multi-section sled configuration is used instead of a uni-body configuration, then fork-receiving pockets 701*a* can modularly combine with the respective left and right pocket sections 703*a* of the second sled frame section 703 to form longer left and right pockets for the assembled sled.

Although all details are not shown in FIG. 7, all of the above described options concerning situating the rear positioned portion 750 of the robotic arm mechanism ahead of clearance lines such as 732*a* may be optionally applied alone or in various combinations as may be suitable for particular, waste-collection environments. All of the above described options including those concerning use of cradles (314 of FIG. 3B), in-pocket dampeners (see FIG. 4B, but here in-pocket dampeners include optional ones for pocket 759), protective cages (FIG. 4A), counterforce peg legs (FIG. 4D) may be optionally applied alone or in various combinations as may be suitable for particular, waste-collection environments. More specifically, the combination of the sled 701-703 and robotic arm mechanism 750 should have or be adapted to engageably cooperate with a clearance means (e.g., cage 701*b*) which helps to keep the rearwardly positioned, major mass portion 750 of the robotic arm mechanism clear of collision with one or more parts of the provided, front-loading vehicle (e.g., 101) during at least one of a first operation where the refuse container 702 is mechanically lifted (e.g., sate 102" of FIG. 1A) for dumping of its contents and a second operation where the retractable side arm 755 reaches out to grab side-situated waste. The clearance means may include bumpers, rearwardly extended pockets, fork clamps, and/or appropriately inserted retainer pins and/or other such means as has already been described above.

Another difference between FIGS. 6 and 7 is that the latter one shows an orthogonal translating motor $M_\Phi$ for forearm 755 in addition to the theta translating motor $M_\Theta$ which rides on Y-reciprocator 752. The phi translating motor $M_\Phi$ is preferably positioned close to the rear of robotic arm mechanism 750 so that its mass, just like the masses of motors $M_\gamma$ and $M_\Theta$ has a relatively short moment arm length with respect to the supporting and retractably engageable lift means (739 and/or 732). The phi translating motor $M_\Phi$ causes the forearm 755 to rotate about an axial line passing through motor $M_\Phi$ where that axial line (not shown) is generally parallel to the Z-axis. This is an alternate or additional way in which grasper 751 may be translated to reach out for grasping waste (e.g., 309*a,b* of FIG. 3A) where the waste situated along the side of the collection vehicle. The length of the phi translatable forearm 755 may be greater in the X-direction than what is shown. (Typically forearm 755 is sufficiently long so that grasping members 751 can ride generally flush alongside container 702 when the robotic arm is in its tucked away state.) The forearm length rotating around the rotational axis of the phi translating motor $M_\phi$ may contribute to the reach out radius and/or other translation of the grasper 751. The operative length of Y-reciprocator 752 may further contribute to the reach out distance.

Yet another difference between FIGS. 6 and 7 is that the latter one shows a non-symmetrical grasper 751 with digits on one side being longer than those on the other side of forearm 755. Although not shown in FIG. 7, further translating motors besides the illustrated $M_\gamma$, $M_\theta$, and phi translating motor $M_\phi$ may be provided for, for example, causing grasper 751 to translate in the psi and/or phi angular directions. Such optional and further motors (which come with the penalty of more mass, more cost and more control complexity) can allow the grasper fingers to be stowed away diagonally along the side wall of container 702 rather than laterally. The more forward digits of grasper 751 may even wrap around and against the front wall of container 702 when in the stowed away (tucked-in) state. If optional door-ramp 702*d* is present though, provisions should be made for rotating the wrap-in-front digits out of the way of the door when the door is being opened and closed.

Figure 8:
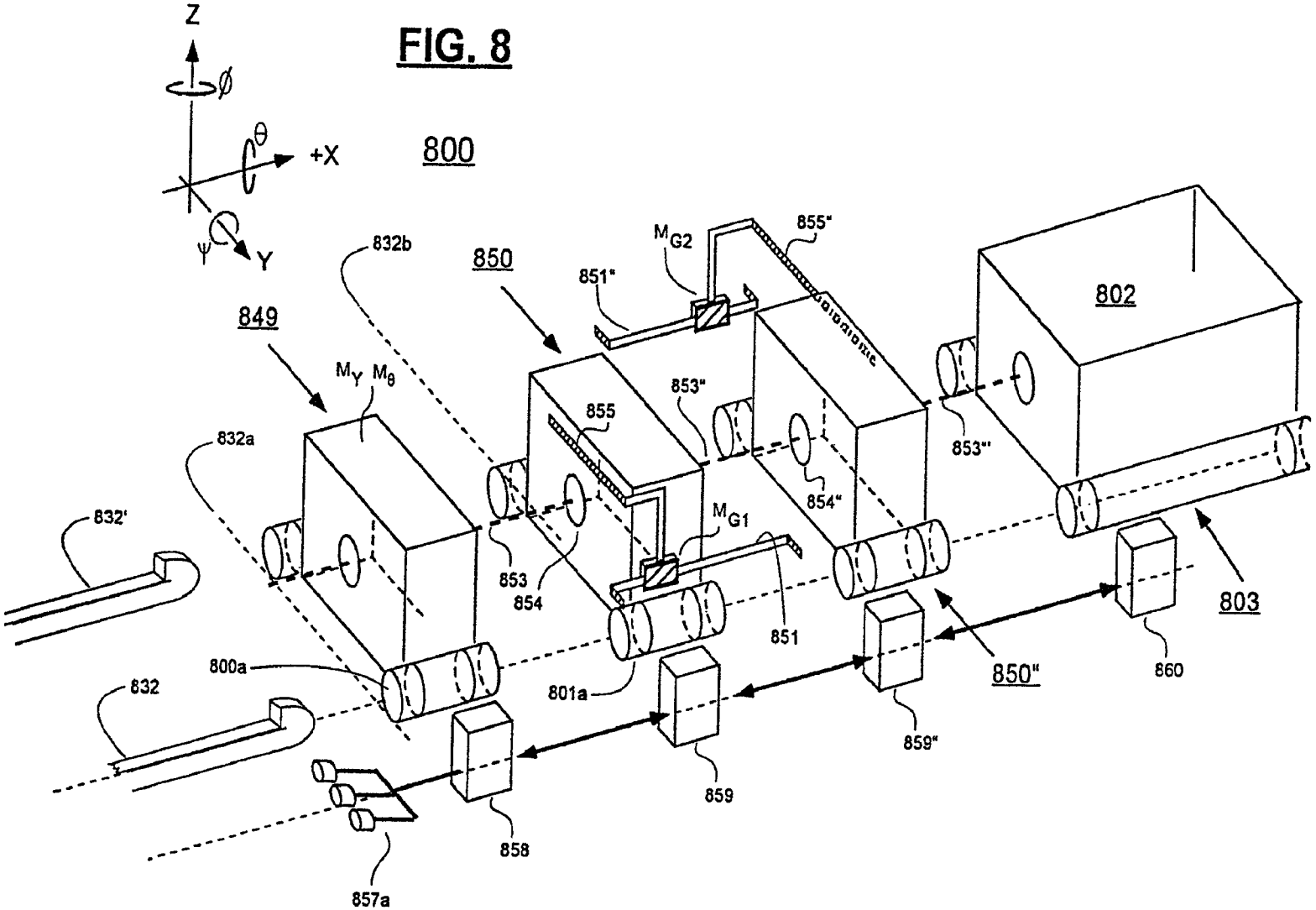
FIG. 8 is a perspective schematic view showing a modularly stackable further combination of robotic arm mechanisms and an intermediate container.

The modularly-assembleable structures disclosed herein allow for a variety of configurations and re-configurations as different needs arise for different waste collection scenarios. FIG. 8 provides a perspective schematic view showing a modularly stackable further combination 800 of a plurality of modularly-assembleable robotic arm mechanisms 850, 850" and an intermediate container 802. At the heart of the modularly-assembleable structures there is the concept of being able to adaptively and safely place a major-mass portion, such as motors-containing modular section 849 to a more rearward position along the chain of modules that will be supported by, and translated by forks 832, 832' and/or other detachably-engageable support and translating means (e.g., A-frame mating head unit 739 of FIG. 7). In the illustrated embodiment 800, the modularly-assembleable, motors-containing section 849 contains the more massive motor means (e.g., $M_\gamma$, $M_\theta$) for powering the reach-out, retract and waste-umping operations of one or more associated, waste-graspers (e.g., 851, 851") which are provided along the chain of further modules. This relatively-large mass portion 849 may be provided in combination with: (1) a rearward-mounting enabling means (e.g., telescopable pocket 800*a*) which allows the major-mass portion 849 to be safely mounted rearward of a detachable or fixedly co-attached intermediate container (e.g., 802) and/or rearward of a detachable or fixedly co-attached, container-supporting frame (e.g., 803) such that the motors-containing section 849 will clear an over-the-top-lift-and-dump clearance line 832*a*, where line 832*a* is positioned relative to inserted forks 832, 832' and allows the most rearward module (e.g., 849) to safely clear the truck cab (not shown) or other obstacles as an front-loading lift and/or dump-over-the-top operation is carried out.

Rotational and/or other mechanical power may be transferred from the main-motors-containing modular section 849 by way of linkage 853 to one or more, stackably-coupled, Arm-Translating and Supporting Modules (ATSM's) such as 850 and 850". Each of ATSM's 850 and 850" includes a respective grasper (851, 851") and a respective, grasper translating arm (855, 855") for translating its corresponding grasper during reach-out, grasp and waste retrieval operations. Inclusion of the illustrated grasper motors ($M_{G1}$, $M_{G2}$) within the ATSM's is optional. In one alternate embodiment, the grasper motors are included in section 849 and a lightweight mechanical power transfer means is used to couple the mechanical grasping/un-grasp power to one or more of the graspers. In one alternate embodiment, the main-motors-containing modular section 849 is integrated together with ATSM 850 so that both ride on a common sled 800*a*-801*a*.

In the illustrated embodiment 800, ATSM 850 (Arm-Translating and Supporting Module) has its own telescopable pockets set 801*a* which allows the more-rearward ATSM 850 to be positioned so that its out-reaching grasper 851 safely clears a fork-pistons clearance line 832*b* and/or other such clearance boundaries. Telescopic adjustment of pockets set 801*a* allows the moving parts (e.g., 851, 855) of ATSM 850 to operate unobstructedly when the chain of stacked modules 849-850-850"-803 is leveled by the forks 832, 832' into a waste collecting mode. In one embodiment, the telescopable pockets set 801*a* of module 850 are symmetrically telescopable in the +X and −X directions so that a 180 degree rotation of a copy of module 850 provides the illustrated module 850", with its respective robotic arm 855" reaching-out to the street-side. (The respective robotic arm 855 of ATSM 850 reaches out to the opposed curbside direction.) By stacking ATSM's 850 and 850" as shown, a waste-collecting vehicle can automatically collect from both sides of a same driveway while driving in just one direction along the driveway. (See again FIG. 5A.) In regard to FIG. 8, it should be noted that the graspers 851, 851" are shown to have asymmetrically sized digits. It is to be understood that the disclosure contemplates embodiments where the digits extend alongside the intermediate container 802 and where the container is detachable from its sled 803. The digits of graspers 851, 851" are shown to be positioned rearward of the sides of container 802 so that the modular concept can be better seen. It is within the contemplation of the disclosure to have grasper motors MG which rotate 180 degrees about lines parallel to the Y axis so that appropriate clearances are obtained when the rest of the module 850 or 850" is rotated 180 degrees.

A symmetrical mechanical-power coupling means 854 may be provided with each of the stackable modules such that each module can be rotated 180 degrees if desired and yet be able to receive mechanical-power 853 from the main-motors-containing modular section 849 and/or forward such mechanical-power to the next stackable module. The container-supporting sled 803 should also include means 853" for transmitting mechanical-power through the sled 803 so that a forward-mounted ATSM (not shown in FIG. 8) can receive such rotational or other power. Hydraulic power and/or electrical power and/or control should be similarly, symmetrically transmittable in quick disconnect fashion through respective power/control boxes 858, 859, 859" and 860 of respective modules 849, 850, 850" and 860. The hydraulic power and/or electrical power and control may, of course, pass through the main, quick disconnect couplers 857*a* to the waste-collecting vehicle. Wireless control such as via radio or infrared signals may be used.

It may therefore be seen that a conveniently reconfigurable and modular system may be provided in accordance with the disclosure. Module stacking and/or symmetry is not limited to the lateral direction (+/−X axis). Modules may be designed to stack side by side in the same plane and possibly on top of one another. The modules should be provided in detachable or fixed combination with detachable-engagement receiving means (e.g., 800*a*, 801*a* in FIG. 8; 759, 601*a* in earlier figures) for allowing the major-mass portion (849) and its ATSM's (850, 850") to be safely supported (together with grasped waste, if any) by one or more retractably-insertable forks (e.g., 832) and/or other detachably-engageable support and translating means (e.g., A-frame mating head unit 739) such that the associated robotic arm mechanisms (graspers and arms) can safely carry out reach-out and waste-capturing operations and retract and waste-dumping operations while the major-mass portion is in the rearward-mounted position. The modules should additionally or alternatively be provided in detachable or fixed combination with detachably-couplable power/control means (e.g., 857*a*, 858, 859, 859") for allowing the major-mass portion to safely receive and/or forward hydraulic, electrical and/or other forms of empowering energy as may be appropriate and/or to safely receive and/or forward electromagnetic and/or other forms of control signals as may be appropriate for allowing the associated robotic arm mechanisms to safely carry out their reach-out and waste-capturing operations and retract and waste-dumping operations while the major-mass portion is in the rearward-mounted position and to allow the major-mass portion to be easily decoupled from its power and/or control signal sources (e.g., 311*a*) when the major-mass portion is to be detached from the waste-collecting vehicle (e.g., 301') or other transporting and empowering means.

A modularly-assembleable combination in accordance with the disclosure may therefore include a major motors-mass portion 849 and one or more associated graspers 851, 851" and the accompanying mounting means for the grasper-carrying arms 855, 855" and other associated parts if any. The modularly-assembleable combination should include detachable-engagement receiving means (800*a*, 801*a*) and/or detachably-couplable power/control transfer means (857*a*, 858-860) arranged so that the modules may be modularly stacked with each other. The assemblable configurations should include one where a first Modularly-Assembleable Component (MAC) can be positioned aft of an intermediate container (e.g., 502 of FIG. 5A for example) while a second, and preferably lighter, such MAC (e.g., like 550' of FIG. 5A) is forward of the same intermediate container. The MAC's should be capable of being stacked horizontally or vertically relative to one another such that one MAC is oriented to capture and retrieve waste from a right side (507*a*) of a driveway while another is oriented to capture and retrieve waste from the left side (507*b*) of a driveway and both can dump their respectively captured and retrieved waste into a common intermediate container (e.g., 802). Only one of the MAC's (preferably the most rearward one, the master MAC) may contain the major motor-mass means for empowering mechanical operations while other, co-coupled MAC's (slave MAC's) may have less massive, motion-transfer means (e.g., 451*c* of FIG. 4D) for transferring mechanical power from the major motor means of the master MAC to the moving parts of the other, co-coupled, slave MAC's. (Alternatively, one or more of the major motor-mass modules (e.g., 849) may be fixedly attached to a crossbar between the rearward ends of the lift forks and such, fork-mounted motors may be detachably couplable to one or more, detachable slave MAC's for powering those slave MAC's.) Horizontal and/or vertical stacking of MAC's may situate plural ones of the MAC's rearward of the intermediate container and simultaneously forward of the decoupleable source (e.g., 501, 511*a*) of their power and/or control signals. The intermediate container in such a situation can be a removably insertable one (e.g., 702) and the modularly stacked MAC's may share a common support sled (e.g., 701 or 701 in fixed attachment to 703) and/or a common interface (e.g., 757*a*) to the decoupleable source (e.g., 501, 511*a*) of their power and/or control signals. Appropriate control and/or power directing means may, of course, be included in the vehicle cab and/or remotely thereof (e.g., via wireless coupling) and optionally further in the master MAC for allowing the operator to direct power and/or control to one or another of the simultaneously provided, plural MAC's at appropriate times. By way of example, a same joystick may be used control multiple MAC's while a switch and/or indicator lights may indicate to the operator which MAC is responding to the directed control and/or power. A common roll cage (701*b*) may surround the stacked MAC's and/or a common retaining pin (703*i*) or safety chain and/or or other safety measure may securedly keep the plural MAC's on the supporting forks (732) and/or other translatable support means (e.g., 739).

The present disclosure is to be taken as illustrative rather than as limiting the scope, nature, or spirit of the subject matter claimed below. Numerous modifications and variations will become apparent to those skilled in the art after studying the disclosure, including use of equivalent functional and/or structural substitutes for elements described herein, use of equivalent functional couplings for couplings described herein, and/or use of equivalent functional steps for steps described herein. Such insubstantial variations are to be considered within the scope of what is contemplated here. Moreover, if plural examples are given for specific means, or steps, and extrapolation between and/or beyond such given examples is obvious in view of the present disclosure, then the disclosure is to be deemed as effectively disclosing and thus covering at least such extrapolations.

CROSS REFERENCE TO PATENTS (CONTINUED)

(B) U.S. Pat. No. 6,357,988 B1 issued Mar. 19, 2002 to J. O. Bayne and entitled "Segregated Waste Collection System";

(C) U.S. Pat. No. 6,123,497 issued Sep. 26, 2000 to Duell, et al. and entitled "Automated Refuse Vehicle";

(D) U.S. Pat. No. 5,607,277 issued Mar. 4, 1997 to W. Zopf and entitled "Automated Intermediate Container and Method of Use";

(E) U.S. Pat. No. 3,762,586 issued Oct. 2, 1973 to Updike Jr. and entitled "Refuse Collection Vehicle";

(F) U.S. Pat. No. 3,822,802 issued Jul. 9, 1974 to Evans Jr. and entitled "Refuse Collector";

(G) U.S. Pat. No. 4,543,028 issued Sep. 24, 1985 to Bell, et al and entitled "Dump Apparatus for Trash Containers";

(H) U.S. Pat. No. 5,033,930 issued Jul. 23, 1991 to Kraus and entitled "Garbage Collecting Truck";

(I) U.S. Pat. No. 5,266,000 issued Nov. 30, 1993 to LeBlanc, Jr. and entitled "Adapter Apparatus for Refuse Hauling Vehicle";

(J) U.S. Pat. No. 6,139,244 issued Oct. 31, 2000 to VanRaden and entitled "Automated Front Loader Collection Bin";

(K) U.S. Pat. No. 5,221,173 issued Jun. 22, 1993 to Barnes and entitled "Multi-vehicle Transport System for Bulk Materials in Confined Areas"; and (L) U.S. Pat. No. 5,890,865 issued Apr. 6, 1999 to Smith et al and entitled "Automated Low Profile Refuse Vehicle".

Reservation of Extra-Patent Rights, Resolution of Conflicts, and Interpretation of Terms After this disclosure is lawfully published, the owner of the present patent application has no objection to the reproduction by others of textual and graphic materials contained herein provided such reproduction is for the limited purpose of understanding the present disclosure of invention and of thereby promoting the useful arts and sciences. The owner does not however disclaim any other rights that may be lawfully associated with the disclosed materials, including but not limited to, copyrights in any computer program listings or art works or other works provided herein, and to trademark or trade dress rights that may be associated with coined terms or art works provided herein and to other otherwise-protectable subject matter included herein or otherwise derivable herefrom.

If any disclosures are incorporated herein by reference and such incorporated disclosures conflict in part or whole with the present disclosure, then to the extent of conflict, and/or broader disclosure, and/or broader definition of terms, the present disclosure controls. If such incorporated disclosures conflict in part or whole with one another, then to the extent of conflict, the later-dated disclosure controls.

Unless expressly stated otherwise herein, ordinary terms have their corresponding ordinary meanings within the respective contexts of their presentations, and ordinary terms of art have their corresponding regular meanings within the relevant technical arts and within the respective contexts of their presentations herein.

Given the above disclosure of general concepts and specific embodiments, the scope of protection sought is to be defined by the claims appended hereto. The issued claims are not to be taken as limiting Applicant's right to claim disclosed, but not yet literally claimed subject matter by way of one or more further applications including those filed pursuant to 35 U.S.C. §120 and/or 35 U.S.C. §251.

What is claimed is:

1. A method for assembling a plurality of modularly-assembleable and disassembleable structures so as to form an operable combination having at least a first robotic arm mechanism that is operable to selectively grasp curbside-situated waste or a curbside-situated waste container and to subsequently selectively ungrasp what has been grasped, the operable combination also having a corresponding at least first front-loadable intermediate container having a rear and a front and defining a total refuse containment volume for containing a corresponding total volume of refuse transferable thereto by the first robotic arm mechanism after the modularly-assembleable combination is assembled and energized, where the operable combination is to be liftingly supported by and energized by a pre-specified and to-be-provided front-loading, waste collecting vehicle, where the vehicle has a frontwardly facing engagement means for disengageably engaging with and mechanically lifting and energizing the assembled and operable combination of the at least first robotic arm mechanism and the at least first front-loadable intermediate container, the method comprising:

providing the first robotic arm mechanism in the form of a major-mass portion and a minor-mass portion coupled to the major-mass portion, where the minor-mass portion includes at least a first waste grasper operative to selectively grasp said curbside-situated waste or curbside-situated waste container and to subsequently selectively ungrasp what has been grasped, where the major-mass portion is modularly and operatively positionable rearward of said total refuse containment volume when the operable combination is liftingly supported frontward of said front-loading, waste collecting vehicle, and where the major-mass portion can detachably interface with the waste collecting vehicle to receive actuating energy and control signals from the waste collecting vehicle by way of the detachable interfacing, where the received actuating energy and control signals are for correspondingly providing actuating energy and control signals at least to the first robotic arm mechanism.

2. The method of claim 1 wherein the major-mass portion of the first robotic arm mechanism includes a first motor that is operable for driving at least part of a "reaching-out-to-curb" operation of the first robotic arm mechanism whereby the first waste grasper is selectively translated towards curbside-situated waste or a curbside-situated waste container for subsequently grasping a to-be-grasped item.

3. The method of claim 2 wherein the major-mass portion of the first robotic arm mechanism includes a second motor that is operable for driving at least part of a load lifting operation of the first robotic arm mechanism whereby the first waste grasper is selectively translated upwards so as to thereby lift an item grasped by the grasper for subsequent disposal of waste therefrom into the first front-loadable intermediate container.

4. The method of claim 3 wherein the major-mass portion of the first robotic arm mechanism includes a third motor that is operable for driving at least part of a grasping or ungrasping operation of the first waste grasper.

5. The method of claim 4 wherein each of the first to third motors includes a hydraulic piston mechanism.

6. The method of claim 5 wherein said detachable interface includes a detachable hydraulic fluid line and a detachable electric control line.

7. The method of claim 1 and further comprising:

including a second robotic arm mechanism in the modularly-assembled combination where the second robotic arm mechanism is of smaller mass than the first robotic arm mechanism and the second robotic arm mechanism is assembled to be disposed forward of the first robotic arm mechanism.

8. The method of claim 1 and further comprising, providing a plurality of modularly-assembleable frame sections and mounting said major-mass portion of the first robotic arm mechanism on a first of said frame sections and mounting said first front-loadable intermediate container on a second of said frame sections.

9. The method of claim 8 wherein the modularly-assembleable frame sections combine to define fork receiving pockets extending through an assembled two or more of the modularly-assembleable frame sections.

10. The method of claim 8 wherein the modularly-assembleable frame sections combine to define extended power and control lines extending within or along an assembled two or more of the modularly-assembleable frame sections.

11. The method of claim 8 wherein an elastomeric shock absorber is interposed between the first of said frame sections and the major-mass portion of the first robotic arm mechanism for absorbing mechanical back-vibrations generated from operations of the first robotic arm mechanism.

12. The method of claim 8 wherein the first front-loadable intermediate container is removably fastened to the second of said frame sections.

13. The method of claim 12 wherein the intermediate container includes a front door through which refuse may be transported into the intermediate container while the latter is liftingly supported by the waste collecting vehicle.

14. The method of claim 13 wherein the front door opens to define a ramp over which refuse may be transported into the intermediate container.

15. The method of claim 8 wherein the modularly-assembleable frame sections each includes pin holes positioned to align with corresponding pin receptors of insertable lifting forks so that one or more of the frame sections may be locked into position along an inserted pair of lifting forks by means of retainer pins passed through the pin holes of the one or more frame sections and into the corresponding pin receptors of the inserted lifting forks.

16. The method of claim 8 and further comprising:

mounting a second robotic arm mechanism on a third of said frame sections where the second robotic arm mechanism has a corresponding second waste grasper oriented to reach out for waste in a direction opposite to a reach out direction of the first waste grasper.

17. The method of claim 1 wherein the first robotic arm mechanism includes an upwardly rotatable forearm pivotally mounted to a sideways reciprocating main arm that extends sideways towards curbside waste and retracts into a non-extended position.

18. The method of claim 17 wherein the waste grasper is coupled to the upwardly rotatable forearm by means of an L-shaped bracket that conformably wraps about a corner of the first front-loadable intermediate container when the reciprocating main arm is retracted to bring the waste grasper snugly adjacent to a side of the intermediate container.

19. The method of claim 1 wherein the first robotic arm mechanism includes means for stowing the waste grasper snugly adjacent to a side of the intermediate container where fingers of the stowed away grasper extend along a diagonal angle of the grasper stowing side of the intermediate container.

20. The method of claim 1 wherein an intermediate one or more of the modules that are assembled as a chain of modules includes a motor-power pass-through linkage for passing through that intermediate module, wherein motor power is provided from a more rearward one of the assembled modules to a more forward one of the assembled modules.

* * * * *